US008138407B2

(12) United States Patent
Matahira et al.

(10) Patent No.: US 8,138,407 B2
(45) Date of Patent: Mar. 20, 2012

(54) SYNCHRONIZER FOR ENSEMBLE ON DIFFERENT SORTS OF MUSIC DATA, AUTOMATIC PLAYER MUSICAL INSTRUMENT AND METHOD OF SYNCHRONIZATION

(75) Inventors: Kenji Matahira, Iwata (JP); Haruki Uehara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 12/638,049

(22) Filed: Dec. 15, 2009

(65) Prior Publication Data

US 2010/0162872 A1 Jul. 1, 2010

(30) Foreign Application Priority Data

Dec. 26, 2008 (JP) ..... 2008-333219

(51) Int. Cl.
*G10H 1/36* (2006.01)
*G10H 7/00* (2006.01)

(52) U.S. Cl. ..... 84/610

(58) Field of Classification Search ..... 84/645, 84/609, 610
See application file for complete search history.

(56) References Cited

U.S. PATENT DOCUMENTS 6,281,424 B1 * 8/2001 Koike et al. ..... 84/636
6,380,473 B2 * 4/2002 Uehara ..... 84/609
6,600,097 B2 * 7/2003 Shiiya ..... 84/609
6,737,571 B2 * 5/2004 Furukawa ..... 84/610
6,949,705 B2 * 9/2005 Furukawa ..... 84/610
7,206,272 B2 4/2007 Ishii et al.
7,612,277 B2 * 11/2009 Weir et al. ..... 84/609
7,863,513 B2 * 1/2011 Ishii et al. ..... 84/645

FOREIGN PATENT DOCUMENTS

JP 2001-307428 11/2001

* cited by examiner

*Primary Examiner* — Jeffrey Donels
(74) *Attorney, Agent, or Firm* — Harness, Dickey & Pierce, PLC

(57) ABSTRACT

In order to establish an automatic player piano and a home theater system in synchronization for ensemble, a set of playback pattern data expresses a series of pitch names, and is stored in a memory system independent of an audio data file and a music data file; while an audio signal is being supplied from a playback system to a synchronizer of the automatic player piano, the synchronizer extracts samples from the audio signal, and determines a series of pitch names through an FFT and a quantization; the series of pitch names of the samples is compared with the playback pattern data what part of the playback pattern data expresses the series of pitch name; since the each sample appears over an extremely short time period, the synchronizer accurately determines a lapse of time, and selects a note event data code to be processed from the music data file.

20 Claims, 12 Drawing Sheets

| Record No. | Sample No. | Record Data (Peak Number) | | | | | | | |
|---|---|---|---|---|---|---|---|---|---|
| | | 0 | 1 | 2 | 3 | 4 | 5 | 6 | 7 |
| 0 | 0~8191 | n(0,0) | n(0,1) | n(0,2) | n(0,3) | n(0,4) | n(0,5) | n(0,6) | n(0,7) |
| 1 | 512~8703 | n(1,0) | n(1,1) | n(1,2) | n(1,3) | n(1,4) | n(1,5) | n(1,6) | n(1,7) |
| 2 | 1024~9215 | n(2,0) | n(2,1) | n(2,2) | n(2,3) | n(2,4) | n(2,5) | n(2,6) | n(2,7) |
| ⋮ | ⋮ | ⋮ | ⋮ | ⋮ | ⋮ | ⋮ | ⋮ | ⋮ | ⋮ |
| k | 512k ~512k+8191 | n(k,0) | n(k,1) | n(k,2) | n(k,3) | n(k,4) | n(k,5) | n(k,6) | n(k,7) |
| ⋮ | ⋮ | ⋮ | ⋮ | ⋮ | ⋮ | ⋮ | ⋮ | ⋮ | ⋮ |

※ n(x,y)⇨Note Number

SYNCHRONIZER FOR ENSEMBLE ON DIFFERENT SORTS OF MUSIC DATA, AUTOMATIC PLAYER MUSICAL INSTRUMENT AND METHOD OF SYNCHRONIZATION

FIELD OF THE INVENTION

This invention relates to a playback technology and, more particularly, to a synchronizer for an ensemble on different sorts of music data, an automatic player musical instrument equipped with the synchronizer and a method for synchronization.

DESCRIPTION OF THE RELATED ART

There are various protocols for music recording. For example, voice messages such as, for example, note-on message and note-off message are defined in the MIDI (Musical Instrument Digital Interface) protocols, and tones produced in a performance are expressed as the voice messages. The pitch name and loudness of a tone to be produced are defined in a note-on data codes together with the note-on event message, and the note-off event message and pitch name of a tone to be decayed are defined in the note-off data code. The note-on event message and note-off event message are indicative of an instruction to generate the tone and an instruction to decay the tone, and term "note event data code" means either of the note-on data code and note-off data code. The note event data codes are produced for generating electronic tones in a real time fashion. Otherwise, a duration data code expresses a time interval between a note event data code and the next note event data code. The duration data codes are stored together with the note event data codes in an information storage medium for recording a performance. Term "MIDI music data codes" means the note event data codes, data codes expressing other voice messages and system messages and duration data codes.

A performance is recorded in an information storage medium as audio data codes. The audio data codes express discrete values on an analog audio signal produced in the performance, and are defined in the Red book.

Users wish to record their performance on a musical instrument equipped with a MIDI data code generator together with a playback from the audio data codes in an information storage medium such as, for example, a DVD (Digital Versatile Disk).

A prior art recording technique is disclosed in Japan Patent Application laid-open No. 2001-307428. According to the Japan Patent Application laid-open, a carrier signal is modulated to an analog quasi audio signal with the MIDI music data codes through the 16DPSK (Differential Phase Shift Keying), and the quasi analog audio signal is converted to quasi audio data codes through a phrase code modulation. A channel of the DVD is assigned to the quasi audio data codes, and another channel is assigned to the audio data codes. While a user is performing a part of a music tune on a musical instrument equipped with MIDI data code generator in ensemble with a playback through the audio data codes, both of the MIDI music data codes and audio data codes are transferred to the recorder, and the quasi audio data codes and audio data codes are stored in the different channels, respectively.

A problem is encountered in the prior art recording technique in that the DVD is exclusively prepared for the playback of ensemble by content providers. The preparation of DVDs is complicated for the content providers.

SUMMARY OF THE INVENTION

It is therefore an important object of the present invention to provide a synchronizer, which makes a playback on a sort of music data synchronized with a playback on another sort of music data sold in a market without any modification of either sort of music data.

It is also an important object of the present invention to an automatic player musical instrument, which is equipped with the synchronizer.

It is another important object of the present invention to provide a method, through which the synchronizer makes the playbacks synchronized each other.

To accomplish the object, the present invention proposes to determine an accurate lapse of time by using features of sound each appearing over a time period determined on a time unit shorter than a time unit of a lapsed time signal.

In accordance with one aspect of the present invention, there is provided a synchronizer for an ensemble between a sound generating system producing sound from an audio signal and an automatic player musical instrument producing tones on the basis of music data codes comprising a measure for lapse of time from an initiation of the generation of the sound determined on a time unit and a memory system storing the music data codes expressing at least pitch of the tones and playback pattern data codes expressing prepared features of the sound correlated with the lapse of time, each of the prepared features appears over a time period determined on another time unit shorter than the time unit, the synchronizer further comprises a feature extractor extracting actual features of the sound from the audio signal, each of the actual features appears over the time period, the synchronizer further comprises a pointer connected to the memory system and the feature extractor, comparing the actual features with the prepared features so as to determine a group of prepared features identical with a group of actual features and determining an accurate lapse of time from the initiation on the aforesaid another on the basis of the group of prepared features and a designator connected to the memory system and the pointer, and designating at least one music data code expressing the tone to be timely produced together with the sound for supplying the aforesaid at least one music data code to the automatic player musical instrument.

In accordance with another aspect of the present invention, there is provided an automatic player musical instrument performing a music tune in ensemble with a sound generating system comprising an acoustic musical instrument including plural manipulators moved for specifying pitch of tones to be produced and a tone generator connected to the plural manipulators and producing tones at the specified pitch, an automatic playing system provided in association with the plural manipulators and analyzing music data codes expressing at least pitch of the tones so as selectively to give rise to the movements of the plural manipulators without any fingering of a human player, and a synchronizer for an ensemble between a sound generating system producing sound from an audio signal and the acoustic musical instrument through the automatic playing system, the synchronizer includes a measure for lapse of time from an initiation of the generation of the sound determined on a time unit and a memory system storing the music data codes and playback pattern data codes expressing prepared features of the sound correlated with the lapse of time, each of the prepared features appears over a time period determined on another time unit shorter than the time unit, the synchronizer further includes a feature extractor extracting actual features of the sound from the audio signal, each of the actual features appears over the time period, and the synchronizer further includes a pointer connected to the memory system and the feature extractor, comparing the actual features with the prepared features so as to determine a group of prepared features identical with a group of actual features and determining an accurate lapse of time from the initiation on the aforesaid another time unit on the basis of the group of prepared features and a designator connected to the memory system and the pointer, and designating at least one music data code expressing the tone to be timely produced together with the sound for supplying the afores at least one music data code to the automatic playing system.

In accordance with yet another aspect of the present invention, there is provided a method for establishing a sound generating system and an automatic player musical instrument in synchronization for ensemble, and the method comprises the steps of a) preparing playback pattern data codes expressing prepared features of the sound correlated with a lapse of time determined on a time unit, each of the prepared features appearing over a time period determined on another time unit shorter than the time unit, b) extracting actual features of the sound from the audio signal, each of the actual features appearing over the time period, c) comparing the actual features with the prepared features so as to determine a group of prepared features identical with a group of actual features, d) determining an accurate lapse of time from the initiation on the aforesaid another time unit on the basis of the group of prepared features, e) specifying at least one music data code to be processed for generating a tone together with sound generated through the sound generating system on the basis of the group of prepared features, and f) supplying the at least one music data code to the automatic player musical instrument.

BRIEF DESCRIPTION OF THE DRAWINGS

The features and advantages of the synchronizer, automatic player musical instrument and method will be more clearly understood from the following description taken in conjunction with the accompanying drawings, in which.

DESCRIPTION OF THE PREFERRED EMBODIMENTS

Figures 1, 3:
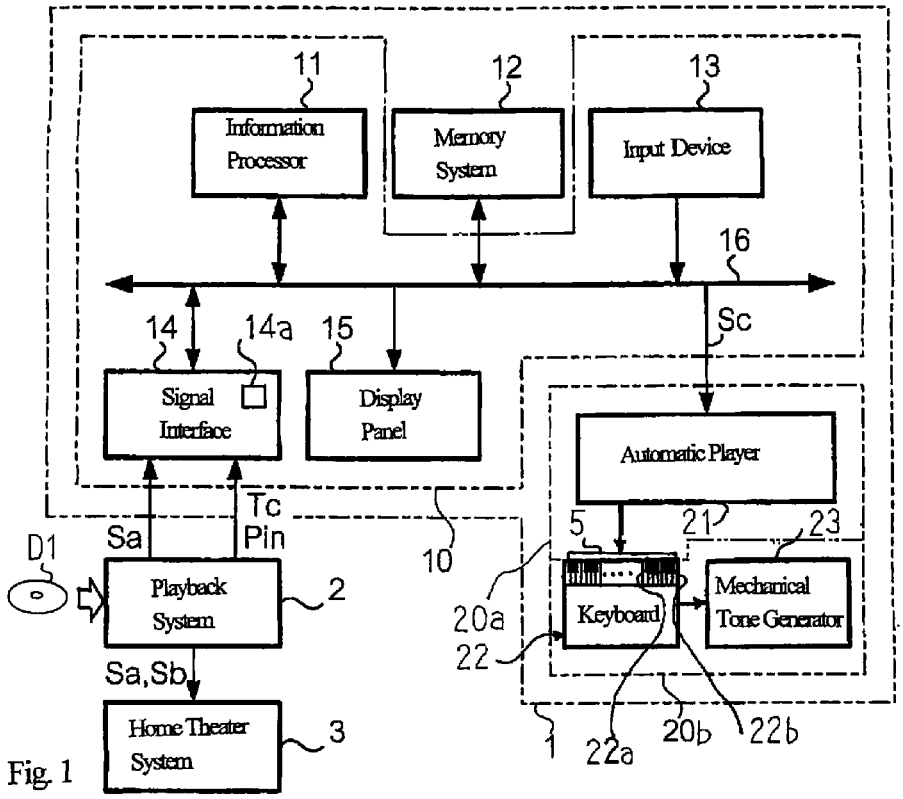
FIG. 1 is a block diagram showing the system configuration of an automatic player piano of the present invention.
FIG. 3 is a view showing the data structure of playback pattern data.

An ensemble system embodying the present invention largely comprises an automatic player musical instrument and a sound generating system connected to each other. The sound generating system produces an audio signal from audio data codes, and generates sound from the audio signal. The automatic player piano performs a music tune on the basis of music data codes without any fingering of a human player. In other to establish the sound generating system and automatic player musical instrument in synchronization for ensemble. The sound generating system supplies the audio signal to the automatic player musical instrument.

The automatic player musical instrument largely comprises an acoustic musical instrument, an automatic playing system and a synchronizer. The acoustic musical instrument is played by the automatic playing system, and the synchronizer makes the performance by the automatic playing system synchronized with the generation of sound through the sound generating system for good ensemble.

The acoustic musical instrument includes plural manipulators and a tone generating system. A human player or the automatic playing system selectively moves the manipulators for specifying pitch of tones to be produced. The plural manipulators are connected to the tone generator, and the tone generator produces tones at the specified pitch.

The automatic playing system sequentially analyzes the music data codes, and selectively gives rise to the movements of the plural manipulators. For this reason, the acoustic piano produces the tones without any fingering of a human player.

The synchronizer includes a measure, a memory system, a feature extractor, a pointer and a designator. In this instance, the measure, feature extractor, pointer and designator are realized through execution of a computer program.

The measure indicates and renews lapse of time from an initiation of the generation of the sound determined on a time unit. The memory system stores the music data codes and playback pattern data codes, and the playback pattern data codes expresses prepared features of the sound correlated with the lapse of time. Each of the prepared features appears over a time period determined on another time unit shorter than the time unit.

The feature extractor extracts actual features of the sound from the audio signal, and each of the actual features also appears over the time period. The pointer is connected to the memory system and the feature extractor, and compares the actual features with the prepared features so as to determine a group of prepared features identical with a group of actual features. The pointer determines an accurate lapse of time from the initiation on the aforesaid another time unit on the basis of the group of prepared features. The designator is connected to the memory system and the pointer, and designates at least one music data code, which expresses the tone to be timely produced together with the sound. The aforesaid at least one music data code is supplied from the designator to the automatic playing system. The designator can supply the at least one music data code to the automatic playing system at accurate timing by virtue of the accurate lapse of time so that the automatic playing system and sound generating system produces the sound and tones in good ensemble.

The playback pattern data codes are prepared for the synchronization independently of the music data codes and audio data codes. For this reason, an information storage medium for storing the audio data codes is available for the ensemble without any modification. An information storage medium for storing the music data codes is also available for the ensemble.

The synchronizer achieves the jobs through a method, and the method comprises a) preparing playback pattern data codes expressing prepared features of the sound correlated with a lapse of time determined on a time unit, each of the prepared features appearing over a time period determined on another time unit shorter than the time unit, b) extracting actual features of the sound from the audio signal, each of the actual features appearing over the time period, c) comparing the actual features with the prepared features so as to determine a group of prepared features identical with a group of actual features, d) determining an accurate lapse of time from the initiation on the aforesaid another time unit on the basis of the group of prepared features, e) specifying at least one music data code to be processed for generating a tone together with sound generated through the sound generating system on the basis of the group of prepared features, and f) supplying the at least one music data code to the automatic player musical instrument.

First Embodiment

Referring first to FIG. 1 of the drawings, an automatic player piano 1 embodying the present invention is connected to a playback system 2, which in turn is connected to a home theater system 3. Plural sets of video data codes and plural sets of audio data codes are stored in a DVD D1, and are prepared in accordance with the MPEG (Moving Picture Coding Experts Group) protocols. The plural sets of audio data codes form plural audio data files, and plural sets of video data codes form plural video data files. Both of audio data file and video data file are referred to as "content data file."

Each of the plural sets of audio data codes or audio data file expresses sound, and the sound may contain plural tones. Each of the plural sets audio data codes expresses a set of audio data, and the set of audio data is accompanied with a piece of identification data. For this reason, the set of audio data codes or set of audio data is specified with the piece of identification data. The piece of identification data expresses a title of the content and/or the number of tracks and/or the time period consumed in reading out the each track, by way of example.

While a set of audio data codes and a set of video data codes are being read out from the DVD D1, an audio signal Sa representative of the read-out audio data codes and a video signal Sb representative of the video data codes are supplied from the playback system 2 to the home theater system 3. When the playback system 2 starts to read out the set of audio data codes, an identification signal Pin representative of the piece of identification data is supplied to the automatic player piano 1. Thereafter, the audio signal Sa and a lapsed time signal Tc are supplied from the playback system 2 to the automatic player piano 1. The lapsed time signal Tc is roughly indicative of the lapse of time from the initiation of playback, and the lapse of time is less reliable for the purpose of synchronization between the home theater 3 and the automatic player piano 1. The unit of lapsed time signal Tc is second.

The home theater system 3 includes a panel display, audio-visual amplifiers and loud speakers, and produces a picture on the panel display from the video signal Sb and the sound through the loud speakers from the audio signal Sa. Various home theater systems are sold in the market, and are well known to persons skilled in the art. For this reason, no further description is hereinafter incorporated for the sake of simplicity.

The automatic player piano 1 largely comprises a synchronizer 10, a memory system 12, an automatic playing system 20*a* and an acoustic piano 20*b*. The synchronizer 10, memory system 12 and automatic playing system 20*a* are installed in the acoustic piano 20*b*, and the memory system 12 is shared between the synchronizer 10 and the automatic playing system 20*a*.

The acoustic piano 20*b* is broken down into a keyboard 22 and a mechanical tone generator 23. The keyboard 22 includes black keys 22*a* and white keys 22*b*, and the black keys 22*a* and white keys 22*b* are laid on a well known pattern. The pitch names of a scale are respectively assigned to the black/white keys 22*a* and 22*b*, and the pitch names are respectively assigned note numbers. The black keys 22*a* and white keys 22*b* are selectively depressed and released for specifying the tones to be produced and tones to be decayed. The black keys 22*a* and white keys 22*b* are connected to the mechanical tone generator 23. The depressed keys 22*a* and 22*b* activates the mechanical tone generator 23 so as to produce the tones at the specified pitch, and the released keys 22*a* and 22*b* deactivate the mechanical tone generator 23 for decaying the tones.

The automatic playing system 20*b* reenacts a performance on the acoustic piano 20*b* without any fingering of a human player, and includes an automatic player 21 and an array of solenoid-operated key actuators 5. The solenoid-operated key actuators 5 are respectively associated with the black/white keys 22*a* and 22*b*. The automatic player 21 makes the solenoid-operated key actuators 5 selectively energized, and the solenoid-operated key actuators 5 energized by the automatic player 21 move the associated black/white keys 22*a* and 22*b* so as to activate and deactivate the mechanical tone generator 23.

The synchronizer 10 is connected to the playback system 2 so that the identification signal Pin, lapsed time signal Tc and audio signal Sa arrive at the synchronizer 10. In this instance, a set of pieces of music data expresses the performance of the automatic playing system 20*a*, and the pieces of music data are coded in accordance with the MIDI (Musical Instrument Digital Interface) protocols.

As well known to persons skilled in the art, the pieces of music data are given to a musical instrument equipped with a MIDI tone generator as voice messages. A typical example of the voice messages is a note-on message for generation of a tone, and another example of the voice messages is a note-off message for decay of the tone. Those voice messages, note event data codes Sc and duration data codes are hereinbefore described in conjunction with the related art. A set of MIDI music data codes Sc expresses a set of pieces of music data for a music tune, and are stored in a music data file. Plural music data files are prepared inside the automatic player piano 1.

In order to make the automatic performance on the automatic player piano 20*b* synchronized with the playback through the home theater system 3, it is necessary timely to supply the MIDI music data codes Sc to the automatic playing system 20*a*.

Playback pattern data Pa is provided for the synchronization, and contains pieces of record data. Each set of the playback pattern data Pa is prepared through sampling on the audio signal Sa, FFT (Finite Fourier Transform) on the samples and quantization as will be herienlater described in detail. The set of playback pattern data Pa contains plural playback sub-pattern. The plural playback sub-patterns express the pieces of record data. The unit time expressed by the lapsed time signal Tc is equivalent to a predetermined number of playback sub-patterns so that each playback sub-pattern is equivalent to a time period much shorter than the time expressed by the lapsed time signal Tc. Thus, the lapse of time is accurately determined by using the playback sub-pattern as the unit. In this instance, the sampling frequency for the playback pattern data Pa is 44.1 kHz.

The plural playback sub-patterns respectively express features of the sound reproduced from the set of audio data codes. The plural sets of playback pattern data Pa are stored in the memory system 12 together with the associated music data files. The synchronizer 10 extracts the features of reproduced sound from the audio signal Sa, and compares each extracted feature with the features expressed by the playback sub-patterns to see what feature is identical with the extracted feature. When the synchronizer 10 finds the feature identical with the extracted feature, the synchronizer 10 determines an accurate lapse of time, which is much more accurate than the time expressed by the lapsed time signal Tc, on the basis of the position of playback sub-pattern matched with the extracted feature in the set of playback pattern data. When the accurate lapse of time is determined, the synchronizer 10 specifies the event data code or codes to be transferred on the basis of the pieces of duration data codes in the music data file. Thus, the synchronizer 10 specifies the event data code or codes to be processed at the accurate lapse of time so that the event data code or codes are timely supplied to the automatic player 20*a*. The automatic player 20*a* processes the note event data code or codes for the automatic performance.

The playback pattern data Pa is prepared independently of the DVDs and CDs. It is not necessary to add any data to the audio data codes stored in the DVDs and CDs sold in the market for the ensemble between the home theater system 3 and the automatic player piano 1 by virtue of the playback pattern data Pa.

While the playback system 2 is supplying the audio signal Sa to the home theater system 3 and the synchronizer 10, the synchronizer 10 continuously extracts the features of reproduced sound from the audio signal Sa, and compares the extracted features with the features expressed by the playback sub-pattern to see what feature is identical with the extracted feature.

The extracted feature is assumed to be identical with one of the features expressed by the playback pattern data Pa. The synchronizer 10 specifies the associated note event data code, and the associated note event data code is transferred to the automatic playing system 20*a*. When the note event data code or codes are transferred to the automatic playing system 20*a*, the automatic playing system 20 sets the time period expressed by the next duration data code into the timer, and starts to count down the timer. The time period expressed by the duration data code is expired. Then, the automatic playing system 20*a* fetches the next note event data code from the memory system 12, and analyzes the next note event data code for the automatic performance. Thus, the automatic playing system 20*a* intermittently processes the note event data codes until extraction of the next feature.

When the synchronizer 10 finds the next extracted feature to be identical with another of the features, the synchronizer 10 specifies the associated note event data code, and the associated note event data code is transferred to the automatic playing system 20*a*. When the associated note event data code is specified, the time period expressed by the duration data code is assumed to be not expired, the automatic playing system 20*a* forcibly resets the timer for the duration data code to zero so that the note event data code is immediately processed through the automatic playing system 20*a*.

On the contrary, the time period expressed by the duration data code is assumed to have been already expired before the associated note event data code is specified. The automatic playing system 20*a* prolongs the time period expressed by the next duration data code by the difference between the time at which the associated note event data code is specified and the time at which the associated note event data code was processed. As a result, the next note event is expected to be timely processed.

As will be understood from the foregoing description, the synchronizer 10 periodically sets the accumulated value of duration data codes by the accurate lapse of time determined through the comparison between the extracted feature and the feature expressed by the playback sub-pattern. As a result, the automatic player piano 1 reenacts the performance in good synchronization with the home theater system 3.

Description is hereinafter made on the acoustic piano 20*b*, automatic playing system 20*a* and synchronizer 10 in detail.

Acoustic Piano

Figure 2:
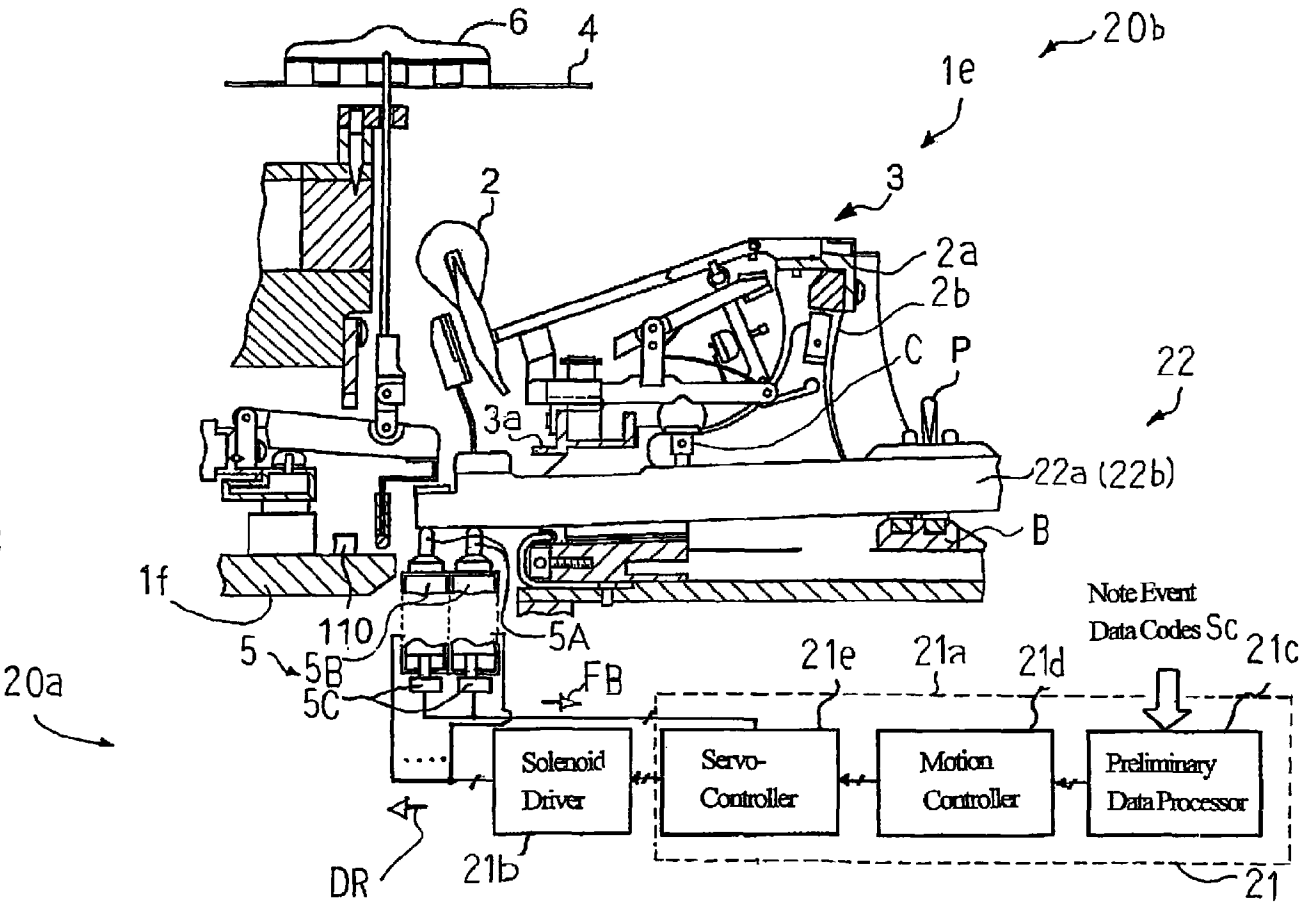
FIG. 2 is a cross sectional side view showing the structure of the automatic player piano.

Turning to FIG. 2 of the drawings, the mechanical tone generator 23 includes hammers 2, action units 3, strings 4, dampers 6 and pedal mechanisms (not shown). The hammers 2 are respectively associated with the black/white keys 22*a* and 22*b*, and the action units 3 are provided between the black/white keys 22*a* and 22*b* and the hammers 3. The strings 4 are respectively associated with the hammers 2, and the dampers 6 are respectively provided between the black/white keys 22*a* and 22*b* and the strings 4.

As described hereinbefore, the black keys 22*a* and white keys 22*b* are incorporated in the keyboard 22, and the total number of keys 22*a* and 22*b* is eighty-eight in this instance. The eighty-eight keys 1*b* and 1*c* are arranged in the lateral direction, which is in parallel to a normal direction with respect to the sheet of paper where FIG. 2 is drawn.

The black keys 22*a* and white keys 22*b* have respective balance pins P and respective capstan screws C. The balance pins P upwardly project from a balance rail B, which laterally extends on the key bed 1*f* of the piano cabinet, through the intermediate portions of keys 22*a* and 22*b*, and offer fulcrums to the associated keys 22*a* and 22*b*. When the front portions of keys 22*a* and 22*b* are depressed, the front portions of keys 22*a* and 22*b* are rotated about the balance rail B, and are sunk. On the other hand, the rear portions of keys 22*a* and 22*b* are lifted. When a human player or the automatic player 21 removes force from the keys 22*a* and 22*b*, the front portions of keys 22*a* and 22*b* are moved to be spaced from the key bed 1*f* by the longest distance, and the keys 22*a* and 22*b* reach rest positions. On the other hand, when the human player or the automatic player 21 exerts the force on the keys 22*a* and 22*b*, the front portions of keys 22*a* and 22*b* are moved in the opposite direction, and the keys 22*a* and 22*b* reach end positions. Term "depressed key" means the key 22*a* or 22*b* moved toward the end position, and term "released key" means the key 22*a* or 22*b* moved toward the rest position.

The hammers 2 are arranged in the lateral direction, and are rotatably supported by a hammer flange rail 2*a*, which in turn is supported by action brackets 2*b*. The action brackets 2*b* stands on the key bed 1*f*, and keep the hammers 2 over the rear portions of associated black keys 22*a* and the rear portions of associated white keys 22*b*.

The action units 3 are respectively provided between the keys 22*a* and 22*b* and the hammers 2, and are rotatably supported by a whippen rail 3*a*. The whippen rail 3*a* laterally extends over the rear portions of black keys 22*a* and the rear portions of white keys 22*b*, and is supported by the action brackets 2*b*. The action units 3 are held in contact with the capstan screws C of the associated keys 22*a* and 22*b* so that the depressed keys 22*a* and 22*b* give rise to rotation of the associated action units 3 about the whippen rail 3*a*. While the action units 3 are rotating about the whippen rail 3*a*, the rotating action units 3 force the associated hammers 2 to rotate until escape between the action units 3 and the hammers 2. When the action units 3 escape from the associated hammers 2, the hammers 2 start free rotation toward the associated strings 4. The detailed behavior of action units 3 is same as that of a standard grand piano, and, for this reason, no further description is incorporated for the sake of simplicity.

The strings 4 are stretched over the associated hammers 2, and are designed to produce the acoustic tones at difference in pitch from one another. The hammers 2 are brought into collision with the associated strings 4 at the end of free rotation, and give rise to vibrations of the associated strings 4 through the collision.

The loudness of acoustic tones is proportional to the final hammer velocity immediately before the collision, and the final hammer velocity is proportional to the key velocity at a reference point, which is a particular key position on the loci of keys 22*a* and 22*b*. The key velocity at the reference point is hereinafter referred to as "reference key velocity". In the standard performance, the human player regulates the finger force exerted on the keys 22*a* and 22*b* to an appropriate value so as to impart the reference key velocity to the keys 22*a* and 22*b*. Similarly, the automatic player 21 regulates the electromagnetic force exerted on the keys 22*a* and 22*b* to the appropriate value in the automatic performance so as to impart the reference key velocity to the keys 22*a* and 22*b*.

The dampers 6 are connected to the rearmost portions of associated keys 22*a* and 22*b*, and are spaced from and brought into contact with the associated strings 4. While the associated keys 22*a* and 22*b* are staying at the rest positions, the rearmost portions of keys 22*a* and 22*b* do not exert any force on the dampers 6 in the upward direction so that the dampers 6 are held in contact with the associated strings 4. The dampers 6 do not permit the strings 4 to vibrate. While a human player or the automatic player 21 is depressing the keys 22*a* and 22*b*, the rearmost portions of keys 22*a* and 22*b* start to exert the force on the associated dampers 6 on the way to the end positions, and, thereafter, cause the dampers 6 to be spaced from the associated strings 4. When the dampers 6 are spaced from the associated strings 4, the strings 4 get ready to vibrate. The hammers 2 are brought into collision with the strings 4 after the dampers 6 have been spaced from the strings 4. The acoustic tones are produced through the vibrations of strings 4. When the human player or the automatic player 21 releases the depressed keys 22*a* and 22*b*, the released keys 22*a* and 22*b* start to move toward the rest positions, and the dampers 6 are moved in the down-ward direction due to the self-weight of dampers 6. The dampers 6 are brought into contact with the strings 4 on the way to the rest positions, and make the vibrations of strings 4 and, accordingly, acoustic tones decayed.

Automatic Playing System

The automatic player 21 and solenoid-operated key actuators 5 form in combination the automatic playing system 20*a* as described hereinbefore. The array of solenoid-operated key actuators 5 is supported by the key bed 1*f*, and the solenoid-operated key actuators 5 are laterally arranged in a staggered fashion in a slot formed in the key bed 1*f* below the rear portions of black/white keys 22*a* and 22*b*. The solenoid-operated key actuators 5 are respectively associated with the black/white keys 22*a* and 22*b* for moving the associated keys 22*a* and 22*b* without fingering of a human player, and are connected in parallel to the automatic player 21.

Each of the solenoid-operated key actuators 5 includes a plunger 5A, a solenoid 5B and a built-in plunger sensor 5C. A driving signal DR is selectively supplied from the automatic player 21 to the solenoids 5B of the solenoid-operated key actuators 5, and the solenoids 5B convert the driving signal DR to electromagnetic field. The plunger 5A is provided inside the solenoid 5B, and the electromagnetic force is exerted on the plunger 5A through the electromagnetic field. The electromagnetic force causes the plungers 5A to project in the upward direction, and the plungers 5A push the rear portions of associated keys 22*a* and 22*b*. As a result, the black/white keys 22*a* and 22*b* travel toward the end positions. When the driving signal DR is removed from the solenoids 5B, the electromagnetic field is extinguished, and the plungers 5A are retracted into the solenoids 5B. As a result, the keys 22*a* and 22*b* return to the rest positions.

The built-in plunger sensors 5C monitor the associated plungers 5A so as to produce a feedback signal FB. The feedback signal FB is representative of the velocity of plunger 5A, and is supplied from the built-in plunger sensors 5C to the automatic player 21.

The automatic player 21 includes an information processing system 21*a* and a solenoid driver 21*b*. The information processing system 21*a* is shared with the synchronizer 10 so that the system configuration of information processing system 21*a* is hereinlater described in conjunction with the synchronizer 10.

The solenoid driver 21*b* is connected to the information processing system 21*a*, and has a pulse width modulator. The solenoid driver 21*b* has plural signal output terminals, which are connected in parallel to the solenoids 5B, so that the driving signal DR is selectively supplied to the solenoids 5B. The solenoid driver 21*b* regulates the duty ratio or the amount of mean current of the driving signal DR to an appropriate value so that the automatic player 21 imparts the reference key velocity to the black keys 22*a* and white keys 22*b* by changing the amount of mean current of the driving signal DR.

A computer program runs on the information processing system 21*a*, and is broken down into a main routine program and subroutine programs. The information processing system 21*a* has timers, and the main routine program branches to the subroutine programs through timer interruptions. One of the subroutine programs is assigned to the automatic playing, and another subroutine program is assigned to the synchronization. The main routine program and subroutine program for synchronization are hereinlater described in conjunction with the synchronizer 10, and description is hereinafter focused on the subroutine program for synchronization.

The subroutine program for the automatic playing realizes functions called as a preliminary data processor 21*c*, a motion controller 21*d* and a servo controller 21*e* shown in FIG. 2. The preliminary data processor 21*c*, motion controller 21*d* and servo controller 21*e* are hereinafter described in detail.

The music data codes are normalized for all the products of automatic player pianos. However, the component parts of acoustic piano 20*b* and solenoid-operated key actuators 5 have individualities. For this reason, the music data codes are to be individualized. One of the jobs assigned to the preliminary data processor 21*c* is the individualization. Another job assigned to the preliminary data processor 21*c* is to select the note event data code or note event data codes Sc to be processed for the next note event or next note events Sc. The preliminary data processor 21*c* periodically checks a counter assigned to the measurement of lapse of time to see what note event data code or note event data codes Sc are to be processed. When the preliminary data processor 21*c* finds the note event data code or note event data codes Sc to be processed, the preliminary data processor 21*c* transfers the note event data code or note event data codes Sc to be processed to the motion controller 21*d*.

The motion controller 21*d* analyzes the note event data codes Sc for specifying the key or keys 22*a* and 22*b* to be depressed or released. The motion controller 21*d* further analyzes the note event data code or codes and duration data codes for a reference forward key trajectory and a reference backward key trajectory. Both of the reference forward key trajectory and reference backward key trajectory are simply referred to as "reference key trajectory."

The reference forward key trajectory is a series of values of target key position varied with time for a depressed key 22*a* or 22*c*. The reference forward key trajectories are determined in such a manner that the depressed keys 22*a* and 22*b* pass through the respective reference points at target values of reference key velocity so as to give target values of final hammer velocity to the associated hammers 2. The associated hammers are brought into collision with the strings 4 at the final hammer velocity at the target time to generate the acoustic tones in so far as the depressed keys 22*a* and 22*b* travel on the reference forward key trajectories.

The reference backward key trajectory is also a series of values of target key position varied with time for a released key 22*a* or 22*b*. The reference backward key trajectories are determined in such a manner that the released keys 22*a* and 22*b* cause the associated dampers 6 to be brought into contact with the vibrating strings 4 at time to delay the acoustic tones. The reference forward key trajectory and reference backward key trajectory are known to persons skilled in the art, and, for this reason, no further description is hereinafter incorporated for the sake of simplicity.

When the time to make a key 22*a* or 22*b* start to travel on the reference key trajectory comes, the motion controller 21*d* supplies the first value of target key position to the servo controller 21*e*. The motion controller 21*d* continues periodically to supply the other values of target key position to the servo controller 21*e* until the keys 22*a* and 22*b* reach the end of reference key trajectories. The feedback signal FB expresses actual plunger velocity, i.e., actual key velocity, and is periodically fetched by the servo controller 21*e* for each of the keys 22*a* and 22*b* under the travel on the reference key trajectories. The servo controller 21*e* determines the actual key position on the basis of the series of values of actual key velocity. The servo controller 21*e* further determines the target key velocity on the basis of the series of values of target key position. The servo controller 21*e* calculates the difference between the actual key velocity and the target key velocity and the difference between the actual key position and the target key position, and regulates the amount of mean current of driving signal DR to an appropriate value so as to minimize the differences. The above-described jobs are periodically carried out. As a result, the keys 22*a* and 22*b* are forced to travel on the reference key trajectories.

One of the keys 22*a* and 22*b* is assumed to be depressed in the automatic performance. The motion controller 21*d* determines the reference forward key trajectory for the key 22*a* or 22*b*, and informs the servo controller 21*e* of the reference forward key trajectory. The servo controller 21*e* determines the initial value of the amount of mean current, and adjusts the driving signal DR to the amount of mean current. The driving signal DR is supplied to the solenoid-operated key actuator 5, and creates the electromagnetic field around the plunger 5A. The plunger 5A projects in the upward direction, and pushes the rear portion of associated key 22*a* or 22*b*. After the small amount of time interval, the servo controller 21*e* determines the target plunger velocity and actual plunger position, and calculates the difference between the actual key position and the target key position and the difference between the actual key velocity and the target key velocity. If the difference or differences take place, the servo controller 21*e* increases or decreases the amount of mean current.

The servo controller 21*e* periodically carries out the above-described job for the key 22*a* or 22*b* until the key 22*a* or 22*b* reaches the end of reference forward key trajectory. As a result, the key 22*a* or 22*b* is forced to travel on the reference forward key trajectory, and makes the associated hammer 2 brought into collision with the string 4 at the time to generate the acoustic tone at the target loudness.

If the depressed key 22*a* or 22*b* is to be released, the motion controller 21*d* determines the reference backward key trajectory for the key 22*a* or 22*b* to be released, and informs the servo controller 21*e* of the reference backward key trajectory. The servo controller 21*e* controls the amount of mean current, and makes the damper 6 to be brought into contact with the vibrating string 4 at the time to delay the tone.

System Configuration of Synchronizer

Turning back to FIG. 1, the system configuration of the synchronizer 10 is illustrated. The synchronizer 10 includes an information processor 11, an input device 13, a signal interface 14, a display panel 15 and a bus system 16. The information processor 11, input device 13, display panel 15 and bus system 16 are shared between the automatic player 21 and the synchronizer 10.

Though not shown in the drawings, the information processor 11 includes a microprocessor, a program memory, a working memory, signal interfaces, other peripheral circuit devices and a shared bus system, and the microprocessor, program memory, working memory, signal interfaces and other peripheral circuit devices are connected to the shared bus system so as to communicate with one another. The microprocessor serves as a CPU (Central Processing Unit), and the program memory and working memory are implemented by suitable semiconductor memory devices such as, for example, ROM (Read Only Memory) devices and RAM (Random Access Memory) devices. The computer program is stored in the program memory, and the instruction codes of computer program are sequentially fetched by the microprocessor so as to achieve predetermined jobs.

The memory system 12 has a large data holding capacity. In this instance, the memory system 12 is implemented by a hard disk unit. The computer program may be stored in the memory system 12. In this instance, the computer program is transferred from the memory system 12 to the program memory after the synchronizer 10 is powered.

The plural music data files are stored in the memory system 12, and are labeled with pieces of selecting data Se, respectively. As described hereinbefore, the audio data files are labeled with the identification data codes expressing the pieces of identification data. Pieces of important information such as, for example, a title of music tune are shared between the selecting data codes and the identification data codes so that each of the music data files, which is correlated with one of the audio data files, is selectable through comparison between the selecting data code labeled with the music data file and the identification data code labeled with the audio data file.

Plural sets of playback pattern data Pa are further stored in the memory system 12, and are labeled with the selecting data codes, respectively. For this reason, each set of playback pattern data Pa is selectable together with the associated music data file through the comparison between the piece of identification data Pin assigned to the audio data file and the piece of selecting data Se. Plural record data groups form the set of playback pattern data Pa, and serve as the playback sub-patterns. The unit time of lapsed time signal Tc is equivalent to a predetermined number of record data groups so that each of the record data groups is equivalent to time period much shorter than the unit time expressed by the lapsed time signal Tc.

When the synchronizer 10 finds the feature of one of the record data groups identical with the feature of sound extracted from the audio signal Sa, the synchronizer 10 specifies the position of the record data group in the set of playback data pattern Pa, and accurately determines the accurate lapse of time by adding the time period equivalent to the specified record data group to the lapse of time expressed by the lapsed time signal Tc.

The accurate lapse of time may be regulated in consideration of the time period consumed in the signal propagation from the playback system 2 to the synchronizer 10 and data processing in the synchronizer 10. In detail, when the synchronizer 10 finds the feature identical with the extracted feature, the playback system 2 supplies the home theater system 3 the audio signal Sa representative of the sound not yet processed in the synchronizer. For this reason, the automatic playing system 20*a* has to process the note event code or codes correlated with a feature ahead of the extracted feature by the time period consumed in the signal propagation and data processing. The synchronizer 10 prolongs the accurate lapse of time by the time period consumed in the signal propagation and data processing. The accurate lapse of time Ta thus prolonged is used for the determination of event data code or codes as follows.

The synchronizer 10 accumulates the time periods expressed by the duration data codes, and compares the accumulated value with the accurate lapse of time. When an accumulated value of time periods is found to be equal to the accurate lapse of time, the synchronizer 10 specifies the note event code or codes to be processed, and the note event code or codes are transferred to the automatic player 21.

FIG. 3 shows the data structure of one of the plural sets of playback pattern data Pa. The plural sets of playback pattern data Pa have been prepared before playback of the music data files through the sampling, FFT on the samples extracted from the audio signal identical with the audio signal Sa and quantization. As described hereinbefore, the plural sets of playback pattern data Pa are correlated with the plural music data files, respectively. Each set of the plural playback pattern data Pa is divided into the plural record data groups, and the plural record data groups are numbered from 0, 1, 2, . . . , k, . . . . The values of lapsed time signal Tc are correlated with selected ones of plural record data groups. For this reason, the selected ones of plural record data groups are specified with the lapsed time signal Tc.

Each of the record data groups stands for 512 samples taken out from the audio signal, which is identical with the audio signal Sa produced through the playback system 2, and represents the feature of sound determined through the FFT (Finite Fourier Transform) on 8192 samples and quantization.

The sampling is carried out at 44.1 kHz so that the 512 samples are equivalent to 12 milliseconds. For example, the record data group labeled with number "0" stands for the feature of 512 samples, i.e., samples 0 to 511 given through the FFT on samples 0 to 8191 and quantization, and the record data group labeled with number "1" stands for the feature of next 512 samples, i.e., samples 512 to 1023 given through the FFT on samples 512 to 8703 and quantization.

The record data group has eight record data codes corresponding to eight higher peaks in the spectrum determined through the FFT, and the eight higher peaks are selected from the group of peaks having values equal to or greater than 25% of the value of the highest peak. The eight higher values takes place at eight values of frequency, and the eight values of frequency are quantized or approximated to the closest note numbers. For example, when a peak takes place at 440 Hz, the peak is mapped to the note number "69" expressing A4. Even if the peak is found at 446 Hz, the frequency of 446 Hz is closest to the frequency of A4 so that the peak is mapped to the note number "69". Thus, the feature of sound, which is expressed by each record data group, means a series of pitch names, i.e., the series of note numbers produced in a predetermined time period equivalent to 8192 samples, i.e., 512 samples followed by 7680 samples.

In FIG. 3, "n(x,y)" stands for each of the record data codes, and "n", "x" and "y" expresses the closest note number, number assigned to the record data group and peak number. The record data codes of each record data group are lined up in the ascending order of pitch such as, for example, n(x, 0)=A2, n(x, 1)=A3, n(x, 3)=C3, n(x, 7)=F5.

The input device 13 is a man-machine interface through which users give instructions and options to the information processor 11, and is, by way of example, implemented by a keyboard, a mouse and switches. The touch panel is formed with transparent switches overlapped with an image producing surface of the display panel 15. When a user gives his or her instruction, he or she pushes a touch panel over the visual image expressing the instruction with the finger, the information processor 11 specifies the pushed area, and determines the given instruction.

The display panel 15 is, by way of example, implemented by a liquid crystal display panel. While the main routine program is running on the information processor 11, the information processor 11 produces visual images expressing a job menu, a list of options, a list of titles of music tunes already stored in the memory system 12 and prompt messages. The information processor 11 further produces visual images on the basis of a control signal supplied from the playback system 2 through the signal interface 14.

The signal interface 14 includes plural signal input terminals and a sampler 14*a*. Selected ones of the plural signal input terminals are respectively assigned to the audio signal Sa and the identification signal Pin/lapsed time signal Tc. The sampler 14*a* carries out sampling on the audio signal Sa at 44.1 kHz, and samples, which are extracted from the audio signal Sa, are transferred from the sampler 14 to the working memory of information processor 11.

Functions of Synchronizer

Figure 4:
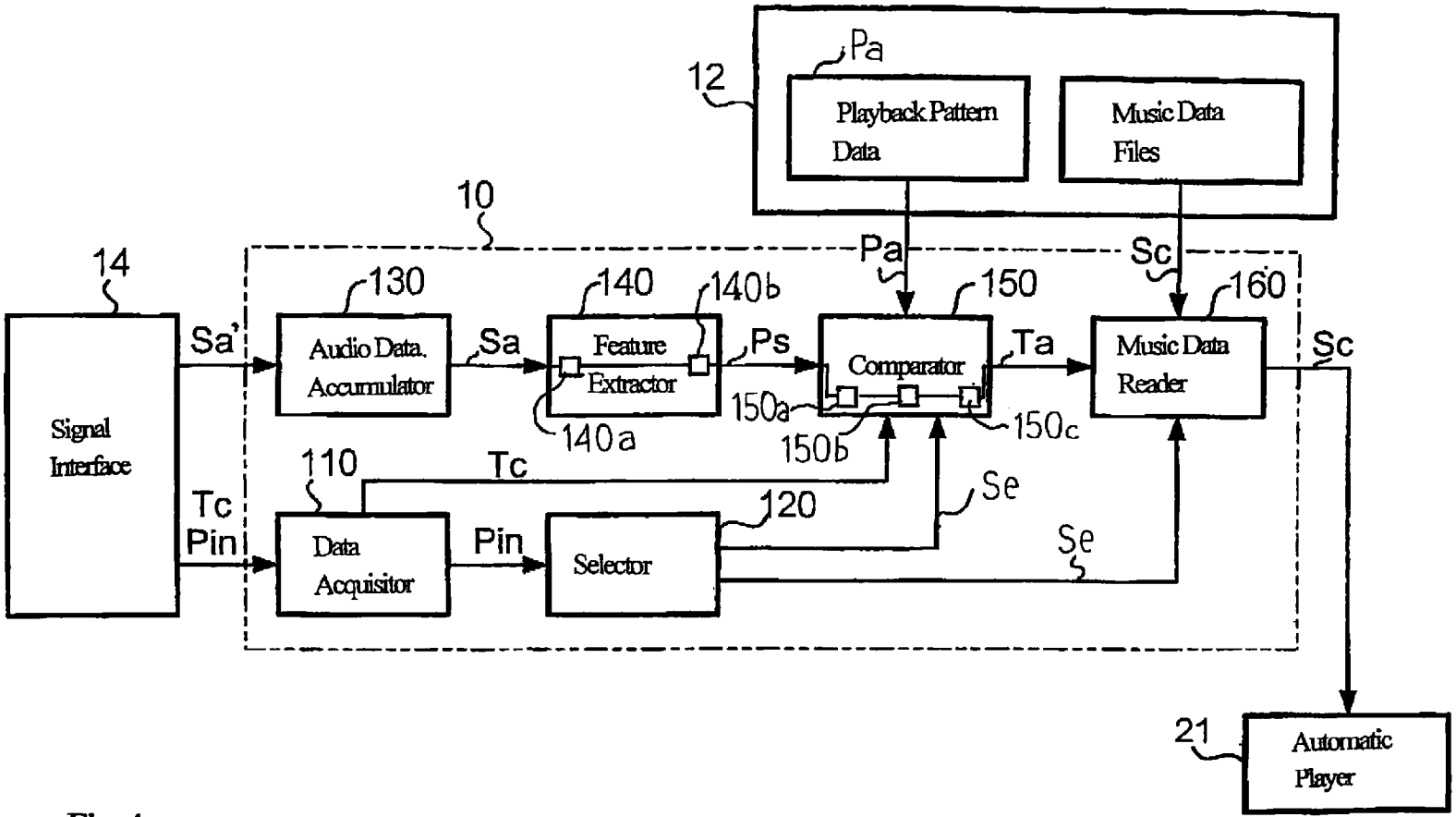
FIG. 4 is a block diagram showing the functions of a synchronizer incorporated in the automatic player piano.

Turning to FIG. 4 of the drawings, while the subroutine program for synchronization is running on the information processor 11, plural functions are realized through the execution, and are referred to as a data acquisitor 110, a selector 120, an audio data accumulator 130, a feature extractor 140, a comparator 150 and a music data reader 160. The feature extractor 140 includes a finite Fourier transformer 140*a* and a quantizer 140*b*.

The data acqusitor 110 is connected to the signal interface 14 and further to the comparator 150, and receives the identification signal Pin and lapsed time signal Tc from the signal interface 14. As described hereinbefore, the piece of identification data is carried on the identification signal Pin, and expresses a title of the audio data file and so forth. The identification signal Pin arrives at the signal interface 14 before the playback so that the data acquisitor 110 acquires the piece of identification data before the initiation of playback.

The data acquisitor 110 is further connected to the selector 120, which in turns is connected to the comparator 150 and music data reader 160. The piece of identification data is transferred from the data acquisitor 110 to the selector 120 before the initiation of playback, and the selector 120 compares the piece of identification data with the pieces of selecting data Se labeled with the sets of playback pattern data Pa and music data files both stored in the memory system 12 to see what piece of selecting data expresses the title same as that of the piece of identification data. When the selector 120 finds the piece of selecting data Se, the selector 120 notifies the comparator 150 and music data reader 160 of the piece of selecting data Se. The comparator 150 specifies a set of playback pattern data Pa with the piece of selecting data Se, and the music data reader 160 also specifies a music data file labeled with the selecting data code expressing the piece of selecting data Se. Thus, the set of playback pattern data Pa and music data file, which are corresponding to the audio data file in the playback system 2, are prepared for the ensemble with the automatic player piano 1 before the initiation of playback.

On the other hand, the lapsed time signal Tc is periodically supplied from the playback system 2 to the signal interface 14 after the initiation of playback. For this reason, the data acquisitor 110 periodically receives the piece of time data expressing the lapse of time from the initiation of playback during the playback. The piece of time data is supplied from the data acquisitor 110 to the comparator 150.

As described hereinbefore, the audio signal Sa is subjected to the sampling at 44.1 kHz so that the samples Sa' are successively transferred to the audio data accumulator 130. The samples Sa' are accumulated in the audio data accumulator 130.

In case where the samples Sa' are sampled at 44.1 kHz, any data conversion is not required for the samples Sa'. On the other hand, if the samples are extracted at a sampling frequency different from 44.1 kHz, the audio data accumulator 130 converts the samples to samples Sa' as if the samples are extracted at 44.1 kHz. Thus, the sampling frequency for the samples Sa' is equal to the sampling frequency for the playback pattern data Pa.

The feature extractor 140 is connected to the audio data accumulator 130, and the accumulated samples Sa' are successively supplied from the data accumulator 130 to the feature extractor 140. The feature extractor 140 carries out the FFT on every 8192 samples Sa', which are equivalent to 186 millisecond, so as to produce acquired pattern data Ps. The acquired pattern data Ps are produced in the similar manner to the playback pattern data Pa, and plural acquired record data groups are incorporated in the acquired pattern data Ps. The record numbers are also respectively assigned to the acquired record data groups, and are indicative of data acquisition time Ta. The record data codes of each record data group express the actual feature of sound expressed by 8192 samples Sa'. In this instance, the samples Sa' equivalent to 2 seconds are fetched by the feature extractor 140 so that the acquired record data groups express the features of sound produced over 2 seconds.

The feature extractor 140 is connected to the comparator 15, which is further connected to the memory system 12. The selecting signal Se has been already supplied to the comparator 150 before the initiation of playback so as to select one of the plural sets of playback pattern data Pa. Since the lapsed time signal Tc is supplied to the comparator 150, the predetermined number of record data groups is periodically read out from the memory system 12 to the comparator 150. In this instance, when one of the record data groups is specified with certain time represented by the lapsed time signal Tc, the record data groups equivalent to 2 seconds before the certain time and record data groups equivalent to 2 seconds after the certain time are read out from the memory system 12 to the comparator 150 together with the record data group specified with the certain time. Thus, the acquired record data groups, which are equivalent to 2 seconds, and the readout record data groups, which are equivalent to 4 seconds, are transferred to the comparator 150.

The comparator 150 includes a selector 150*a*, a similarity analyzer 150*b* and a determiner 150*c*. The selector 150*a* prepares combinations of acquired record data groups and read-out record data groups. The similarity analyzer 150*b* compares the acquired record data groups with the read-out record data groups to see what acquired record data group is identical with the read-out record data group. When the determiner 150*c* finds the feature of a record data group is identical with the extracted feature of acquired record data group, the comparator 150 determines the position of record data group in the predetermined record data groups correlated with the lapse of time signal Tc. Since the number "n" of record data groups is incremented from the initiation of playback, the lapse of time from the initiation of playback is expressed as (n×512×Tsamp) where Tsamp is equivalent to the sampling period of $1/44100$ second. Finally, the synchronizer 10 adds the time period consumed in the data processing and signal propagation to the lapse of time from the initiation of playback, and determined the accurate lapse of time Ta. In case where the record data group labeled with the record number n is found to be identical with the extracted record data group, the accurate lapse of time Ta is expressed as (n×512×Tsamp)+Tx where Tx is the time period consumed in the signal propagation and signal processing.

Description is hereinafter made on how the extracted feature is made identical with one of the features expressed by the record data groups. The similarity DP(t) between an extracted feature of record data group Ps(m) (m=0, 1, . . . , M−1) and a feature expressed by a record data group Pa(n) (n=0, 1, . . . , N−1) is given as $$DP(t)=\Pi D(Pa(t),Ps(j))\ \{j=1\ldots M-1\} \qquad \text{Equation 1}$$

where M is the number of record data groups equivalent to 2 seconds, N is the number of record data groups equivalent to 4 seconds, Pa(t) stands for a record data group of the playback pattern data Pa, t is the lapse of time from initiation of playback and Ps(j) stands for a record data group of the extracted pattern data Ps. "n=0" is not indicative of the record number, and means the first record data group read out from the memory system 12.

The similarity or distance D between two record data groups r0 and r1 is expressed as D (r0, r1). The similarity is calculated for the regions t=0 . . . (N−M−1). As described hereinbefore, eight record data codes are incorporated in each record data group. First, the eight record data codes of record data group are compared with the eight record data codes of extracted record data group, and determines the number "d" of record data codes inconsistent with the record data codes of extracted record data group. The similarity DP(t) is given as $0.9^d$. If all of the record data codes are consistent with all the record data codes of extracted record data group, the similarity is 1. On the other hand, if all the record data codes are inconsistent with all the record data codes of extracted record data group, the similarity is given as $0.9^8$. After repletion of calculation from t=0 to t=(N−M−1), when a record data group of playback pattern data Pa and a record data group of extracted pattern data Ps has a value of 1 or a value closest to 1, the record data group of playback pattern data Pa is deemed to be identical with the record data group of extracted pattern data Ps. The calculation is usually repeated by M times. However, if there is no possibility to find the record data group deemed to be identical with the record data group of extracted pattern data Ps, the synchronizer 10 may stop the calculation before the repetition of M times.

When the comparator 150 determines the accurate lapse of time Ta, the comparator 150 informs the music data reader 160 of the accurate lapse of time Ta. The music data reader 160 sequentially adds the time period expressed by the duration data codes until the sum is equal to the accurate lapse of time Ta. When the music data reader 160 finds the note event data code or codes to be processed through the comparison between the sum and the accurate lapse of time Ta, the music data reader 160 waits for the expiry of the time period expressed by the latest duration data code. Upon expiry of the time period expressed by the latest duration data code, the not event data code or codes are read out from the memory system 12, and are transferred to the automatic player 21.

The automatic player 21 determines the reference key trajectory or trajectories for the key 22*a* or 22*b* or keys 22*a* and 22*b*, and forces the key or keys 22*a* and 22*b* to travel on the reference key trajectory or trajectories through the functions of preliminary data processor 21*c*, motion controller 21*d* and servo controller 21*e*.

The key or keys 22*a* and 22*b* makes the mechanical tone generator 23 activated and/or deactivated so that the acoustic tones are timely produced and/or delayed in ensemble with the sound produced through the home theater system 3.

Subroutine Program for Synchronization

Figure 5A:
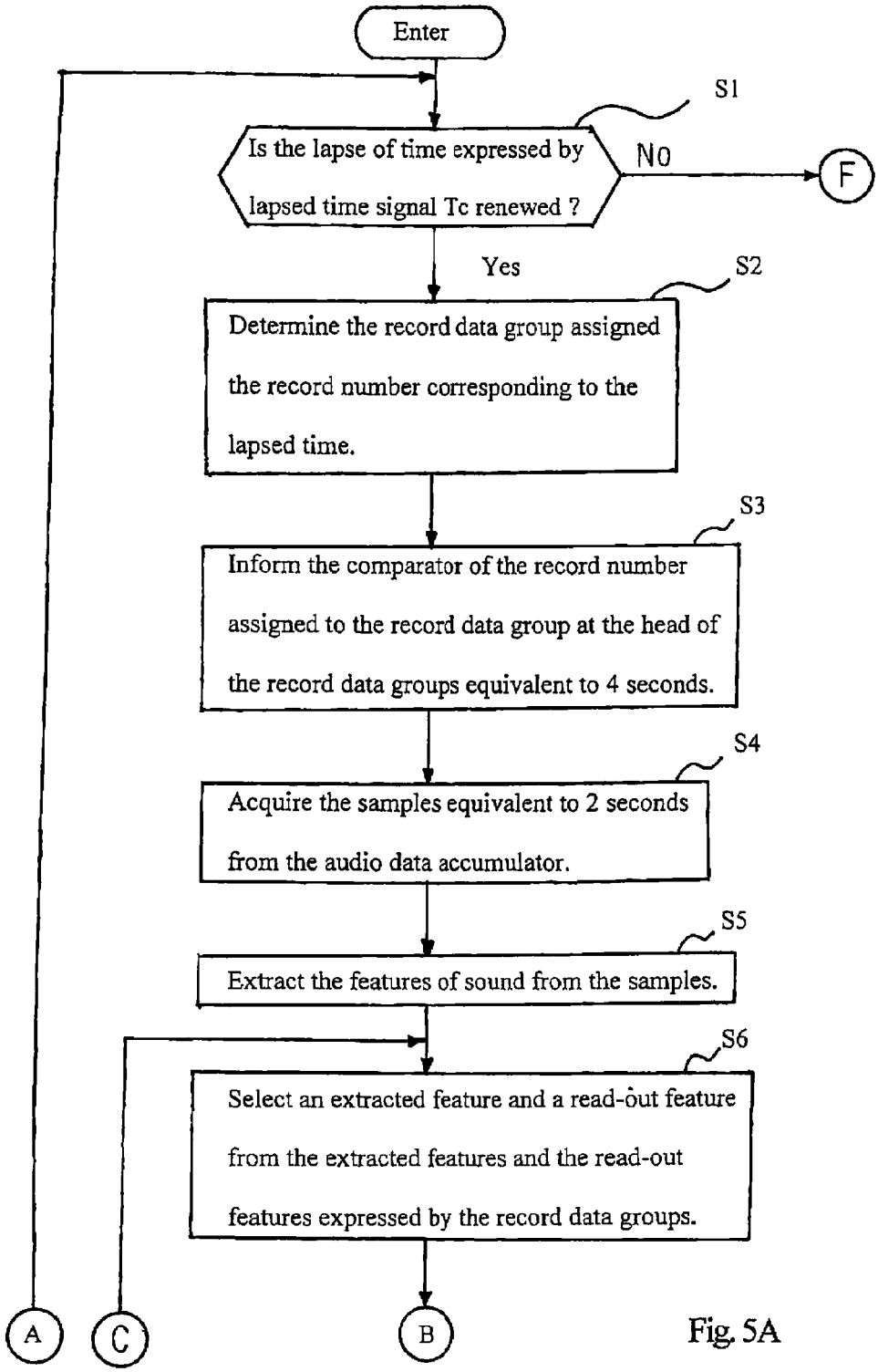
FIGS. 5A to 5C are flowcharts showing a sequence of jobs achieved in execution of a subroutine program for synchronization.
Figure 5B:
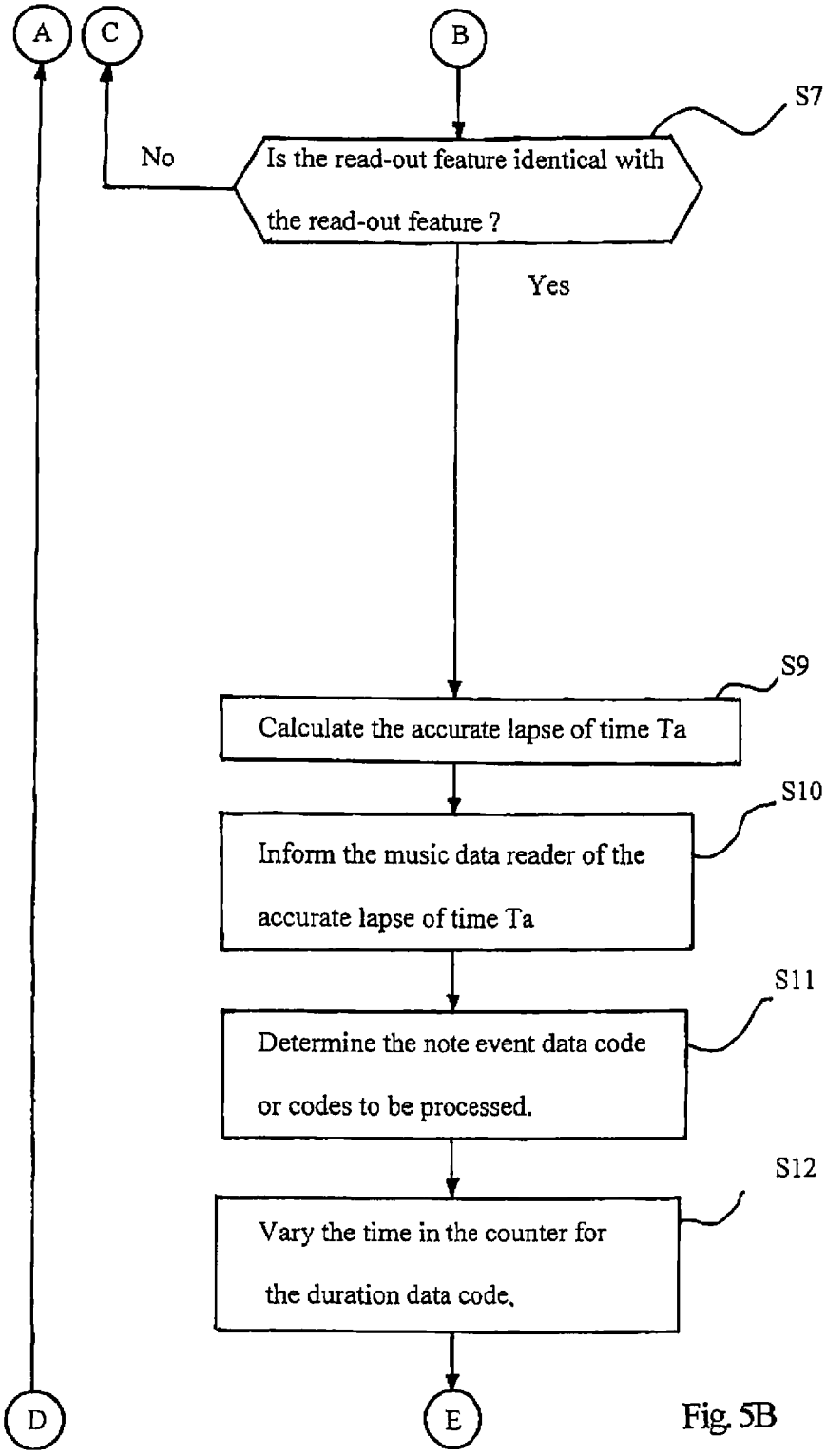
Figure 5C:
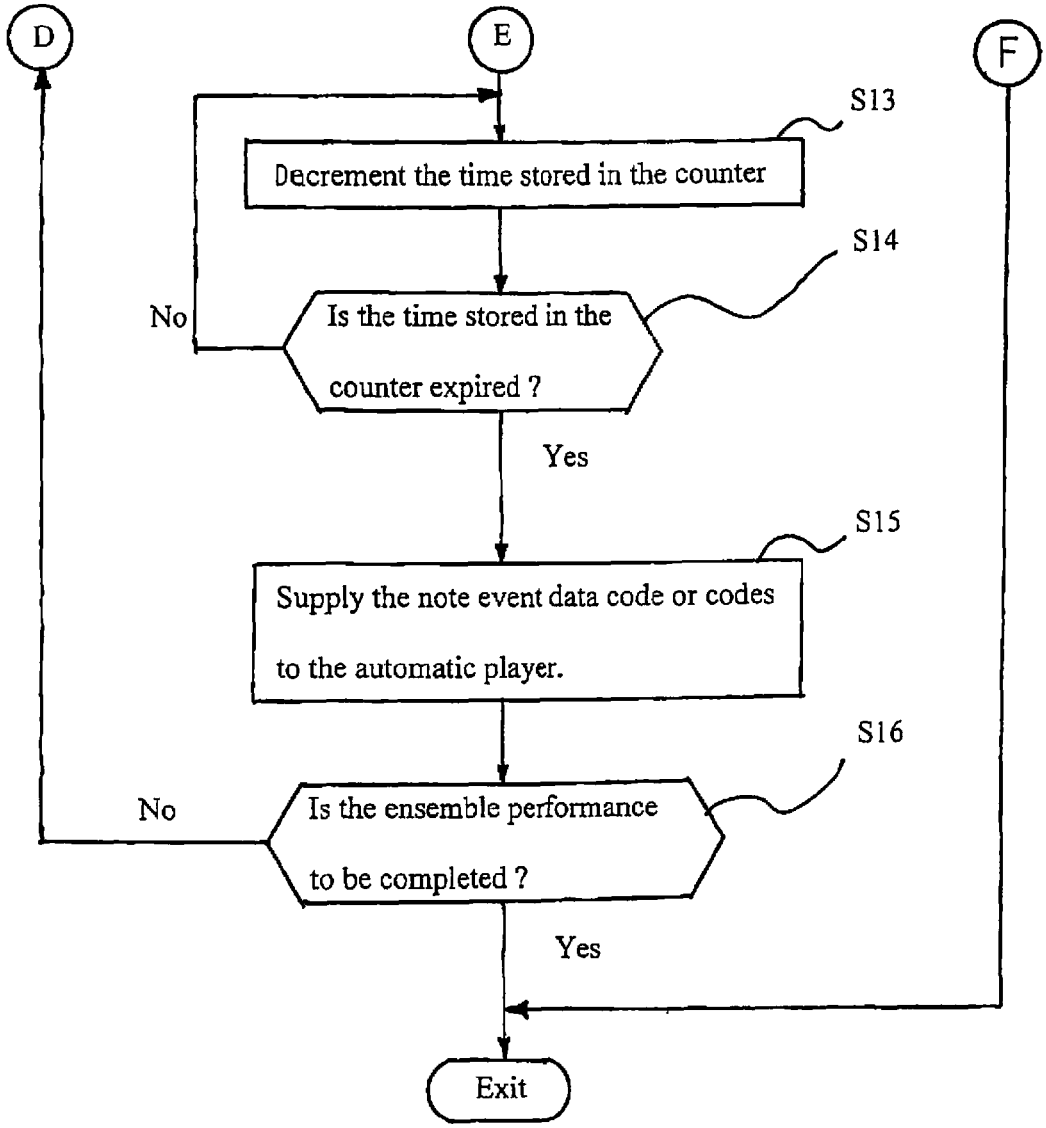

The subroutine program for synchronization is hereinafter described with reference to FIGS. 5A, 5B and 5C. The audio signal Sa is periodically sampled in the signal interface 14, and the samples Sa' are accumulated in the working memory. The lapse of time expressed by the lapsed time signal Tc is periodically fetched by the information processor 11, and the lapse of time is stored in the working memory. The accumulation of samples Sa' and write-in of lapse of time are carried out through another subroutine program. For this reason, the audio data accumulator 130 is realized through execution of another subroutine program. The main routine program starts to branch the subroutine program for synchronization at the initiation of playback on the audio data codes. The main routine program periodically branches to the subroutine program for synchronization through the timer interruptions.

When the information processor 11 enters the subroutine program for synchronization, the information processor 11 checks the working memory to see whether or not the lapse of time is renewed as by step S1. If the lapse of time is same as that in the previous execution at step S1, the answer is given negative "No", and the information processor 11 immediately exits from the subroutine program for synchronization.

On the other hand, when the lapse of time is renewed, the answer at step S1 is given "affirmative", and the information processor 11 specifies the record number corresponding to the lapse of time so as to determine the record data group assigned the record number as by step S2.

Then, the information processor 11 informs the record number to the comparator 150 so that the comparator 150 specifies the record data group at the heat of the record data groups equivalent to 4 seconds as by step S3.

Subsequently, the information processor 11 reads out the samples Sa' equivalent to 2 seconds from the working memory as by step S4, and extracts the features of sound from the samples Sa' through the FFT and quantization as by step S5. Thus, the feature extractor 140 is realized through execution of jobs at steps S4 and S5.

The information processor 11 selects one of the features expressed by the read-out record data groups and one of the extracted features as by step S6, and calculates the similarity between the feature and the extracted feature through the above-described equation 1. The information processor 11 compares the feature with the extracted feature to see whether or not they are identical with one another as by step S7.

When the extracted feature is different from the feature, the answer at step S7 is given negative "No". With the negative answer, the information processor 11 returns to step S6, and selects another feature. Thus, the information processor 11 reiterates the loop consisting of steps S6 and S7 until the change of answer at step S7.

When the extracted feature is identical with the feature, the answer at step S7 is changed to affirmative "Yes". The information processor 11 calculates the accurate lapse of time Ta on the basis of the present lapse of time $T_c$, the position of read-out record data group and time period consumed in the signal propagation and data processing as by step S9. Thus, the comparator 150 is realized through the execution of jobs at steps S6, S7, S8 and S9.

Subsequently, the information processor 11 stores the accurate lapse of time Ta in the working memory as if the comparator 150 informs the music data reader 160 of the accurate lapse of time Ta at step S10. The information processor 11 accumulates the time period expressed by the duration data codes until the accumulated value is equal to the accurate lapse of time Ta. When the accumulated value becomes equal to the accurate lapse of time Ta, the information processor 11 specifies the note event data code or codes at the accurate lapse of time Ta as by step S11. The information processor 11 varies the time stored in the counter for the duration data code as by step S12 so that the counter indicates the time period until the accurate lapse of time.

The information processor 11 decrements the counter value as by step S13, and checks the counter to see whether or not the time period is expired as by step S14.

If the answer is given negative "No", the information processor 11 returns to step S13, and reiterates the loop consisting of steps S13 and S14 until the change of answer at step S14.

When the time period is expired, the answer at step S14 is given affirmative "Yes", and the information processor 11 supplies the note event data code or codes to the automatic player 21 as by step S15. Thus, the music data reader 160 is realized through the execution of jobs at steps S11, S12, S13 and S14.

The information processor 11 checks the working memory to see whether or not the ensemble is to be completed as by step S16. When the answer is given negative "No", the information processor 11 returns to step S1, and reiterates the loop consisting of steps S1 to S16 until the change of answer at step S16.

When all of the audio data codes were processed, or when the user interrupts the ensemble, the answer at step S16 is changed to affirmative "Yes", and the information processor 11 exits from the subroutine program for synchronization.

As will be understood from the foregoing description, the playback pattern data Pa and acquired pattern data Ps are used as time data higher in resolution than the time data expressed by the lapsed time signal Tc, and the synchronizer 10 determines the accurate lapse of time Ta through searching the playback pattern data Pa for the feature of a record data group identical with the extracted feature. The synchronizer 10 determines the note event data codes to be processed at the accurate lapse of time Ta, and establishes the home theater system 3 and automatic player piano 1 in strict synchronization. The playback pattern data Pa is prepared for the ensemble independently of the audio data files and music data files. For this reason, the audio data files, content data files and music data files sold in the market are available for the ensemble without any modification of either of the data files.

Second Embodiment

Figure 6:
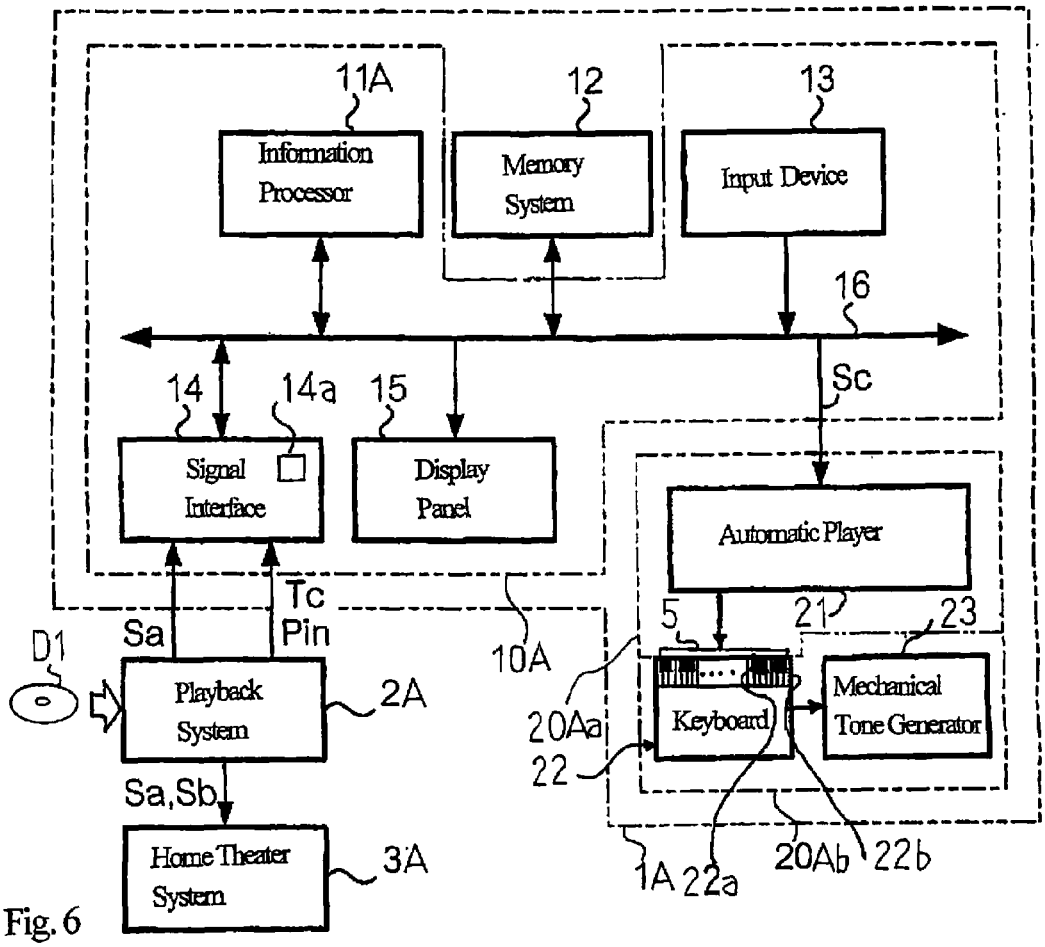
FIG. 6 is a block diagram showing the system configuration of another automatic player piano of the present invention.

Turning to FIG. 6 of the drawings, an automatic player piano 1A embodying the present invention forms an ensemble system together with a playback system 2A and a home theater system 3A. The playback system 2A and home theater system 3A are same as the playback system 2 and home theater system 3.

The automatic player piano 1A comprises a controller 10A, an automatic playing system 20Aa and an acoustic piano 20Ab. The automatic playing system 20Aa and acoustic piano 20Ab are same as the automatic playing system 20*a* and acoustic piano 20*b*, and the controller 10A is similar to the controller 10 except for a part of a computer program running on an information processor 11A. For this reason, description is focused on the computer program, and other components are labeled with references designating the corresponding components of the automatic player piano 1 without detailed description.

Figure 7A:
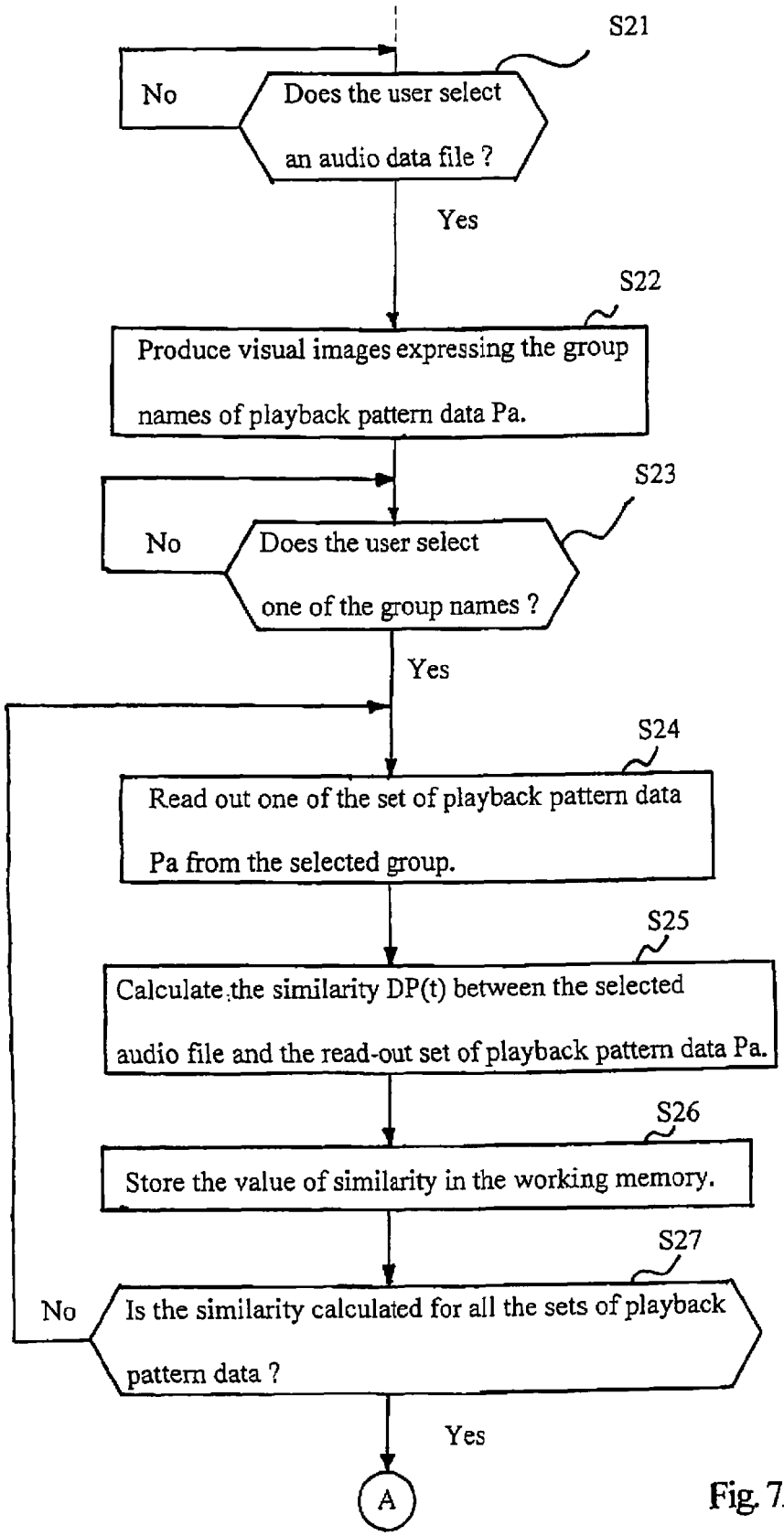
FIGS. 7A and 7B are flowcharts showing jobs of a main routine program executed in the automatic player piano.
Figure 7B:
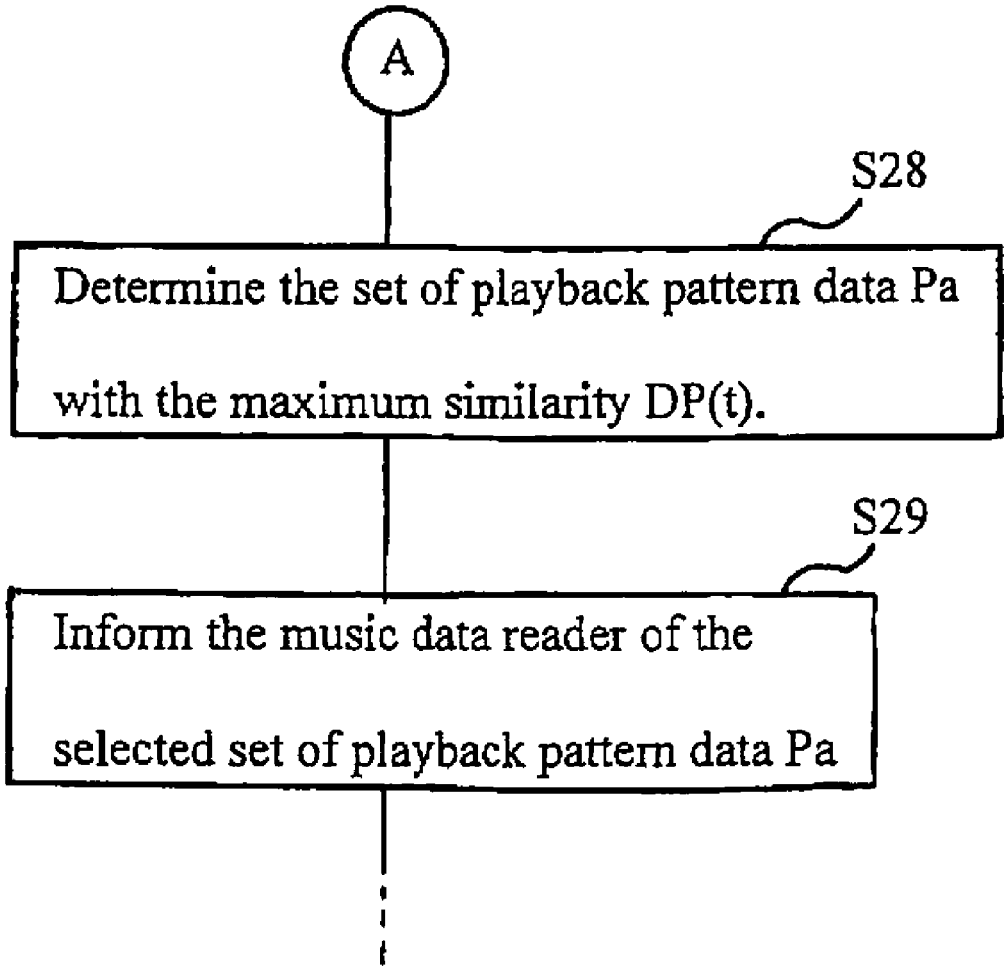

FIGS. 7A and 7B show jobs of a main routine program in the computer program, and the jobs relate to selecting a set of playback pattern data Pa corresponding to the audio data file specified by a user.

The information processor 11A checks the input device 13 to see whether or not the user select one of the audio data files stored in the DVD D1 as by step S21. While the answer is being given negative "No", the information processor 11A repeats the job at step 21 until change of answer.

The user is assumed to select one of the audio data files. The answer at step S21 is given affirmative "Yes". Then, the information processor 11A produces visual images, which express the group names of playback pattern data Pa, on the display panel 15 as by step S22. A player name, a keyword in the titles of music tunes or a category of music may make the plural sets of playback pattern data Pa grouped.

The information processor 11A checks the input device 13 to see whether or not the user selects one of the group names as by step S23. While the answer is given negative "No", the information processor 11A repeats the job at step S23.

When the user selects one of the group names, the answer at step S23 is changed to affirmative "Yes", and the information processor 11A reads out one of the plural sets of playback pattern data Pa from the selected group as by step S24. The information processor 11A calculates the similarity DP(t) between the selected audio data file and the read-out set of playback pattern data Pa as by step S25. The result of calculation is stored in the working memory as by step S26.

The information processor 11A checks the selected group to see whether or not the similarity DP(t) is calculated for all the sets of playback pattern data as by step S27. While the answer at step S27 is being given negative "No", the information processor 11A returns to step S24, and reiterates the loop consisting of steps S24, S25, S26 and S27 until change of answer at step S27.

When the calculation result is stored in the working memory for all the sets of playback pattern data Pa, the answer at step S27 is changed affirmative "Yes", and the information processor 11A determines a set of playback pattern Pa, which has the maximum similarity DP(t) as by step S28.

The information processor 11A writes the set of playback pattern data Pa in the working memory as if the music data reader is informed of the set of playback pattern data Pa as by step S29. Thus, one of the music data files becomes ready to access. In order to correlate the sets of playback pattern data Pa with the music data files, a table may be prepared in the memory system 12.

Upon completion of the job at step S29, the information processor 11A proceeds to other jobs of the main routine program.

If all the values of similarity DP(t) are smaller than a threshold, the information processor 11A selects one of the remaining sets of playback pattern data Pa through the comparison with the extracted feature Ps and the features in the remaining sets of playback pattern data Pa.

As will be appreciated from the foregoing description, the pieces of selecting data Sa are not indispensable for the correlation between the audio data files and the sets of playback pattern data Pa.

Third Embodiment

Figure 8:
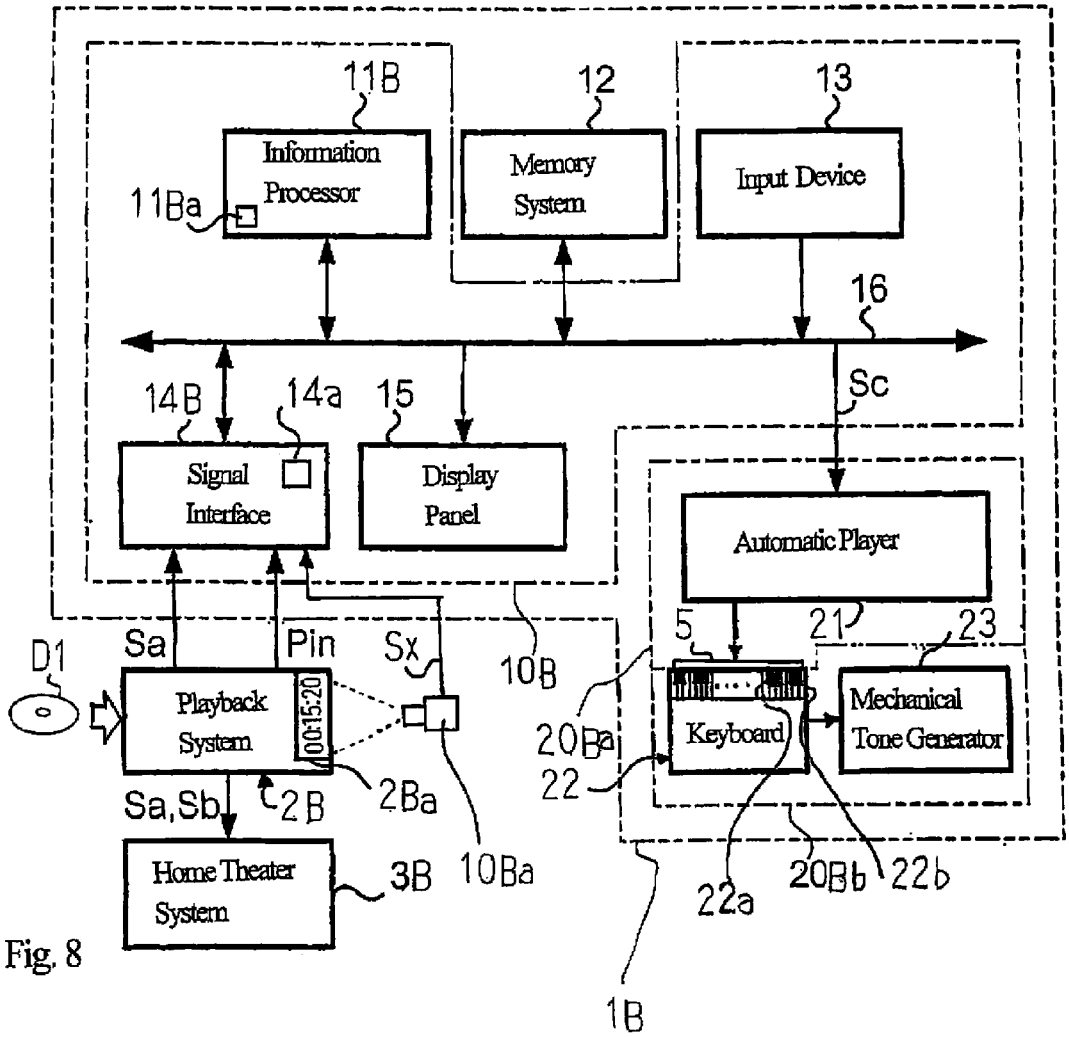
FIG. 8 is a block diagram showing the system configuration of yet another automatic player piano of the present invention.

Turning to FIG. 8 of the drawings, an automatic player piano 1B embodying the present invention forms an ensemble system together with a playback system 2B and a home theater system 3B. The playback system 2B is similar to the playback system 2 except for a display window 2Ba for producing visual images of the lapse of time, and the home theater system 3B is same as the home theater system 3.

The display window 2Ba produces six digits and two colons. The leftmost two digits are indicative of an hour or hours, and rightmost two digits are indicative of a second or seconds. The intermediate two digits are indicative of a minute or minutes, and two colons separate the rightmost two digits and leftmost digits from the intermediate two digits. The six digits and two colons indicate the lapse of time from the initiation of playback. The playback system 2B produces the visual images from the lapsed time signal Tc. However, the lapsed time signal Tc is not supplied to the signal interface 14B of synchronizer 10B.

The automatic player piano 1B comprises a controller 10B, an automatic playing system 20Ba and an acoustic piano 20Bb. The automatic playing system 20Ba and acoustic piano 20Bb are same as the automatic playing system 20*a* and acoustic piano 20*b*, and the controller 10B is similar to the controller 10 except for a CCD (Charge Coupled Device) camera 10Ba and a part of a computer program running on an information processor 11B For this reason, description is focused on the CCD camera 10Ba and computer program, and other components are labeled with references designating the corresponding components of the automatic player piano 1 without detailed description.

The CCD camera 10Ba is directed to the display window 2Ba, and converts the images on the display window 2Ba to a visual image signal Sx. The visual image signal Sx is supplied from the CCD camera 10Ba to the signal interface 14B, and are transferred to the working memory.

The computer program is also broken down into a main routine program and subroutine programs. One of the subroutine programs is assigned to the synchronization, and the subroutine program for synchronization contains jobs for character recognition. The jobs for character recognition realizes a character recognizer 11Ba, and the character recognizer 11Ba form a part of the data acquisitor 110. Thus, the lapse of time from the initiation of playback is determined through the character recognition in the third embodiment. For this reason, the lapsed time signal Tc is not any indispensable feature of the present invention.

Fourth Embodiment

Figure 9:
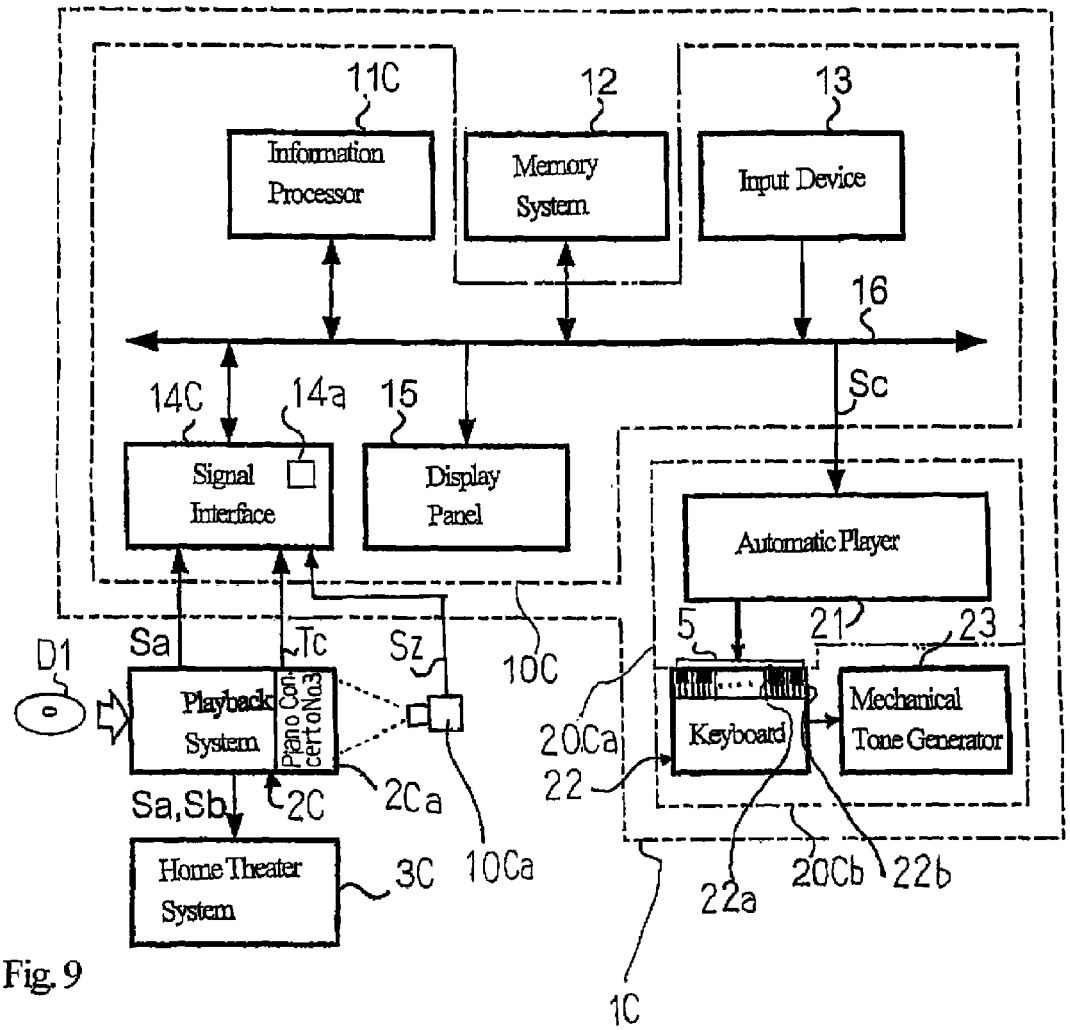
FIG. 9 is a block diagram showing the system configuration of still another automatic player piano of the present invention.

Turning to FIG. 9 of the drawings, an automatic player piano 1C embodying the present invention forms an ensemble system together with a playback system 2C and a home theater system 3C. The playback system 2C is similar to the playback system 2 except for a display window 2Ca for producing visual images of a title of music tune, and the home theater system 3C is same as the home theater system 3.

The display window 2Ca produces alphabetical letters, and the alphabetical letters express a title of a music tune selected by a user. The visual images such as, for example, "Piano Concerto No. 3" is produced on the display window 2Ca on the basis of the piece of identification data. For this reason, the identification signal Pin is not supplied to the signal interface 14C of synchronizer 10C.

The automatic player piano 1C comprises a controller 10C, an automatic playing system 20Ca and an acoustic piano 20Cb. The automatic playing system 20Ca and acoustic piano 20Cb are same as the automatic playing system 20*a* and acoustic piano 20*b*, and the controller 10C is similar to the controller 10 except for a CCD (Charge Coupled Device) camera 10Ca and a part of a computer program running on an information processor 11C. For this reason, description is focused on the CCD camera 10Ca and computer program, and other components are labeled with references designating the corresponding components of the automatic player piano 1 without detailed description.

The CCD camera 10Ca is directed to the display window 2Ca, and converts the visual images on the display window 2Ca to a visual image signal Sz. The visual image signal Sz is supplied from the CCD camera 10Ca to the signal interface 14C, and are transferred to the working memory.

The computer program is also broken down into a main routine program and subroutine programs. One of the subroutine programs is assigned to the synchronization, and the subroutine program for synchronization contains jobs for character recognition. The jobs for character recognition form a part of the data acquisitor 110. Thus, the piece of identification data is determined through the character recognition in the fourth embodiment. For this reason, the identification signal Pin is not any indispensable feature of the present invention.

Although particular embodiments of the present invention have been shown and described, it will be apparent to those skilled in the art that various changes and modifications may be made without departing from the spirit and scope of the present invention.

The automatic player pianos 1, 1A, 1B and 1C do not set any limit to the technical scope of the present invention. An automatic player musical instrument may be fabricated on the basis of another sort of acoustic musical instrument such as, for example, a violin, a guitar, a trumpet or a saxophone.

In the first to fourth embodiment, a series of pitch names serves as a "feature". However, the pitch name does not set any limit to the technical scope of the present invention. For example, the length of tones may serve as the "feature" of sound.

The number of samples in each record data group may be less than or greater than 512, and the FFT may be carried out on another number of samples less than or greater than 8192. In case where the number of samples is less than 8192, the peaks may be less than eight. On the other hand, if the number of samples is greater than 8192, more than eight peaks may be selected from the candidates.

The ascending order of pitch does not set any limit to the technical scope of the present invention. The record data codes may be lined up in the descending order of pitch or in the order of peak value.

The automatic player piano 1 may further include an electronic tone generator and a sound system. In this instance, users have two options, i.e., the automatic performance and performance through electronic tones. When the user selects the automatic performance, the MIDI music data codes are supplied to the automatic player 21, and the automatic player 21 selectively moves the black keys 22*a* and white keys 22*b* so as to make the acoustic piano 20*b* produce the acoustic piano tones through the mechanical tone generator 23. On the other hand, if the user selects the performance through the electronic tones, the MIDI music data codes are supplied to the electronic tone generator, and an audio signal is produced from the pieces of waveform data on the basis of the note event data codes. The audio signal is supplied to the sound system, and is converted to the electronic tones through the sound system.

The time period consumed in the signal propagation and data processing may be taken into account in the work in which the playback pattern data Pa is prepared.

The time lag takes place between the read-out from the DVD D1 and the generation of sound through the home theater system 3. In order to make the home theater system 3 and the automatic player piano 1 strictly synchronized, the time lag may be taken into account for the accurate lapse of time Ta. Users may input the lag time through the input device 13. Otherwise, the home theater system 3 informs the synchronizer 10 of the time lag during the system initialization.

The audio data accumulator 130 and feature extractor 140 are available for preparation work for the playback pattern data Pa.

When a user pushes a quick traverse button or a backward button of the playback system 2, the accurate lapse of time Ta is drastically changed. In this situation, the synchronizer 10 may immediately restart the sub-routine program shown in FIGS. 5A to 5C. Since the lapse of time Tc is renewed at time intervals of 1 second, the synchronizer 10 may restart the execution on the condition that the difference in lapse of time is fallen within the range of zero to 2 seconds.

When the user pushes the buttons, the playback system 2 may inform the synchronizer of the manipulation. In this situation, the synchronizer 10 immediately analyzes the lapse of time signal Tc.

The playback pattern data Pa and music data files may be downloaded into the synchronizer 10 through a communication network such as, for example, the internet. In this instance, the pieces of selecting data Se, a data ID of the playback pattern data Pa and a data ID of the music data file are correlated with one another in the data base of the server computer, and the set of playback pattern data Pa and music data file are downloaded to the synchronizer in response to a piece of identification data supplied from the automatic player piano.

The music data file may be transferred from a CD (Compact Disk), a DVD, a floppy disk, an optical disk or the playback system 2 to the memory system 12. In this situation, the playback pattern data Pa is downloaded from the database of server computer.

The display window 2Ba may be independent of the playback system 2B. In this instance, an electronic clock is connected to the playback system. When the playback starts, a trigger signal is supplied from the playback system to the electronic clock so that the visual images are produced from a time signal internally incremented.

The computer program may be offered to users as that stored in an information storage medium such as a magnetic disk, a magnetic cassette tape, an optical disk, an optomagnetic disk or a semiconductor memory unit. Otherwise, the computer program may be downloaded through the internet.

In the second embodiment, the playback pattern data Pa is specified through the similarity. However, a modification of the second embodiment may produce the visual images expressing the sets of playback pattern data Pa of the selected group together with a prompt message. The user selects one of the sets of playback pattern data Pa through the input device 13.

The home theater systems 3, 3A, 3B and 3C do not set any limit to the technical scope of the present invention. Only the audio signal Sa may be supplied to loud speakers.

The FFT does not set any limit to the technical scope of the present invention. Another frequency analysis method is available for the frequency analysis.

The MPEG protocols do not set any limit to the technical scope of the present invention. The synchronizer of the present invention makes it possible to process any content data prepared on the basis of another protocols in so far as pieces of visual image data are to be synchronized with associated pieces of audio data, for which the playback pattern data are prepared, and it is possible roughly to specify the piece of audio data just reproduced in second or a time period longer than a second as unit time.

Figure 10:
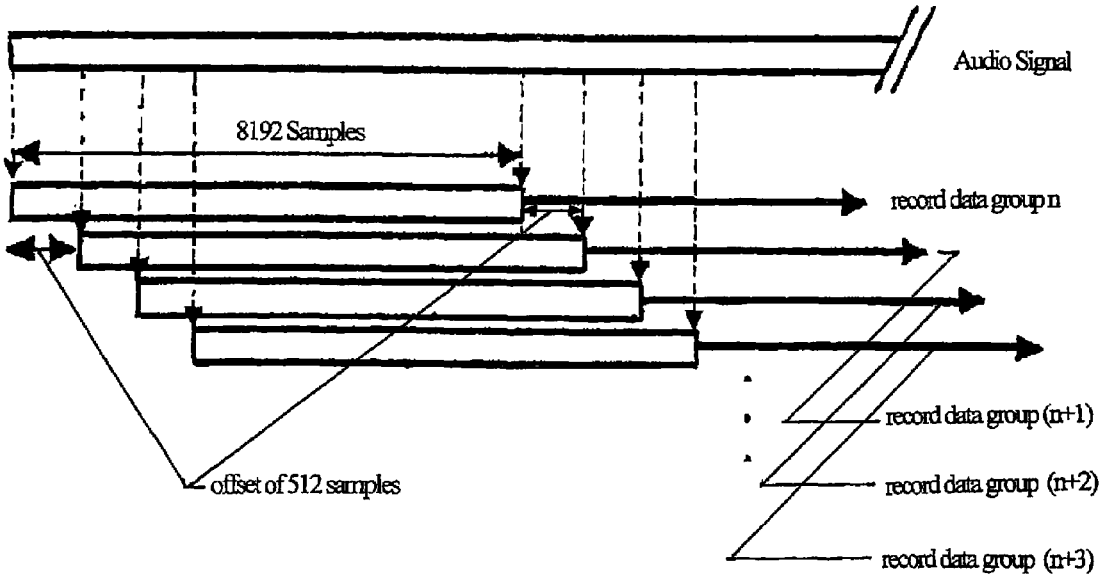
FIG. 10 is a view showing a relation between samples and record data groups.

The record data groups may be partially overlapped with one another as shown in FIG. 10. In this instance, the record data groups (n+1), (n+2) and (n+3) are respectively overlapped with the record data groups (n), (n+1) and (n+2) by 512 samples. The long record data groups (n), (n+1), (n+2) and (n+3) make the adjacent series of pitch names clear, and the accuracy of consistency between the acquired record data group and the read-out record data group is enhanced by virtue of the short offset.

In case where a standard MIDI file is used as the music data file, pieces of data, which are stored in the header chunk of standard MIDI file, are available as the pieces of identification data. However, the pieces of data stored in the header chunk are strictly defined in the protocols. For this reason, in case where the pieces of identification data are different from the pieces of data stored in the header chunk, the pieces of identification data may be stored in a proper portion in front of the data block assigned to the pieces of music data.

The components of ensemble systems implementing the first to fourth embodiments are correlated with claim languages as follows.

The playback system 2, 2A, 2B or 2C and home theater system 3, 3A, 3B or 3C as a whole constitute a "sound generating system, and the automatic playing system 20*a*, 20Aa, 20Ba or 20Ca is corresponding to "an automatic playing system." The data acquisitor 110 or the combination of CCD camera 10Ba and data acquisitor 110 serves as "a measure", and a second is corresponding to "a time unit." The memory system 12 is corresponding to "a memory system", and the music data codes stored in the music data file and the set of playback pattern data codes Pa serve as "music data codes" and "playback pattern data codes." 12 milliseconds is "another time unit."

The feature extractor 140 and comparator 140 serve as "a feature extractor" and "a pointer", and the pitch name is equivalent to "a prepared feature" and "an actual feature". The series of pitch names, i.e., eight pitch names serve as "a group of prepared features" and "a group of actual features", and the group of actual feature is extracted from 8192 samples equivalent to the record data group assigned one of the record number. The music data reader 160 is corresponding to "a designator."

The analog-to-digital converter 14*a* serves as "a sampler." The finite Fourier transformer 140*a* and quantizer 140*b* are corresponding to "a finite Fourier transformer" and "a quantizer". The selector 150*a*, similarity analyzer 150*b* and determiner 150*c* serve as "a selector", "a similarity analyzer" and "a determiner". The display panel 15 and information processor 11B serve as "a visual image producer", and the input device 13 is corresponding to "an input device."

The automatic player piano 1, 1A, 1B or 1C serves as "an automatic player musical instrument", and the piano 20*b* is corresponding to "an acoustic musical instrument". The black keys 22*a* and white keys 22*b* are corresponding to "plural manipulators", and the hammers 2, action units 3, strings 4 and dampers 6 as a whole constitute "a tone generator." The automatic playing system 20*a*, 20Aa, 20Ba or 20Ca is corresponding to "an automatic playing system."

What is claimed is:

1. A synchronizer for an ensemble between a sound generating system producing sound from an audio signal and an automatic player musical instrument producing tones on the basis of music data codes, comprising:

a memory system storing said music data codes expressing at least pitch of said tones and playback pattern data codes expressing prepared features of said sound correlated with lapse of time, each of said prepared features appearing over a time period determined on another time unit; and an information processor having information processing capability, a computer program running on said information processor so as to realize a measure for said lapse of time from an initiation of the generation of said sound determined on a time unit, said another time unit being shorter than said time unit;

a feature extractor extracting actual features of said sound from said audio signal, each of said actual features appearing over said time period;

a pointer connected to said memory system and said feature extractor, comparing said actual features with said prepared features so as to determine a group of prepared features identical with a group of actual features, and determining an accurate lapse of time from said initiation on said another time unit on the basis of said group of prepared features;

a designator connected to said memory system and said pointer, and designating at least one music data code expressing the tone to be timely produced together with said sound for supplying said at least one music data code to said automatic player musical instrument and a sampler connected between a signal input assigned to said audio signal and said feature extractor, and producing said samples from said audio signal through a sampling, each of said actual features being determined on the basis of a predetermined number of samples, wherein said another time unit being equal to another time period occupied by said predetermined number of samples.

2. The synchronizer as set forth in claim 1, wherein said sampling is carried out at 44.1 kHz.

3. The synchronizer as set forth in claim 2, in which said predetermined number is 512.

4. The synchronizer as set forth in claim 1, in which each of said prepared features and each of said actual features are a pitch name of tones contained in said sound.

5. The synchronizer as set forth in claim 4, in which said feature extractor includes a finite Fourier transformer determining a frequency spectrum of samples of said audio signal through a finite Fourier transformation, and a quantizer connected to said finite Fourier transformer, and quantizing peak frequency values of said frequency spectrum to frequency values expressing pitch names of a music scale.

6. The synchronizer as set forth in claim 1, in which said pointer includes a selector extracting plural groups of prepared features around a value of said lapse of time and plural groups of actual features from said prepared features and said actual features, respectively, a similarity analyzer connected to said selector and successively comparing each of said plural groups of prepared features with said plural group of actual features for determining similarity of combinations between said each of said plural groups of prepared features and said plural groups of actual features, and a determiner determining the combination with the maximum similarity as said group of prepared features identical with said group of actual features.

7. The synchronizer as set forth in claim 1, in which said sound generating system produces a lapsed time signal representative of said lapse of time from said initiation, and supplies said lapsed time signal to said measure.

8. The synchronizer as set forth in claim 1, in which said sound generating system produces visual images expressing said lapse of time, and said measure has an image-pickup device for converting said visual image to a video signal and a character recognizer supplied with said visual image so as to determine said lapse of time.

9. The synchronizer as set forth in claim 1, further comprising a visual image producer producing visual images expressing candidate groups in which one of said candidate groups contains said playback pattern data codes, an input device connected to visual image producer and used by a user so as to select one of said candidate groups, and a similarity analyzer connected to said input device and said visual image producer and calculating similarity between sets of prepared features expressed by sets of playback pattern data codes of said one of said candidate groups and said actual features for selecting one of said sets of prepared features as those expressed by said playback pattern data codes.

10. An automatic player musical instrument performing a music tune in ensemble with a sound generating system, comprising:

an acoustic musical instrument including plural manipulators moved for specifying pitch of tones to be produced, and a tone generator connected to said plural manipulators, and producing tones at the specified pitch;

an automatic playing system provided in association with said plural manipulators, and analyzing music data codes expressing at least pitch of said tones so as selectively to give rise to the movements of said plural manipulators without any fingering of a human player; and a synchronizer for an ensemble between said sound generating system producing sound from an audio signal and said acoustic musical instrument through said automatic playing system, said synchronizer including a memory system storing said music data codes and playback pattern data codes expressing prepared features of said sound correlated with lapse of time, each of said prepared features appearing over a time period determined on another time unit and an information processor having information processing capability, a computer program running on said information processor so as to realize a measure for said lapse of time from an initiation of the generation of said sound determined on a time unit, said another time unit being shorter than said time unit, a feature extractor extracting actual features of said sound from samples of said audio signal, each of said actual features appearing over said time period;

a pointer connected to said memory system and said feature extractor, comparing said actual features with said prepared features so as to determine a group of prepared features identical with a group of actual features and determining an accurate lapse of time from said initiation on said another time unit on the basis of said group of prepared features and a designator connected to said memory system and said pointer, and designating at least one music data code expressing the tone to be timely produced together with said sound for supplying said at least one music data code to said automatic playing system, and a sampler connected between a signal input assigned to said audio signal and said feature extractor, and producing said samples from said audio signal through a sampling, each of said actual features being determined on the basis of a predetermined number of samples, wherein said another time unit being equal to another time period occupied by said predetermined number of samples.

11. The automatic player musical instrument as set forth in claim 10, in which sampling is carried out at 44.1 kHz.

12. The automatic player musical instrument as set forth in claim 11, in which said predetermined number is 512.

13. The automatic player musical instrument as set forth in claim 10, in which each of said prepared features and each of said actual features are a pitch name of tones contained in said sound.

14. The automatic player musical instrument as set forth in claim 13, in which said feature extractor includes a finite Fourier transformer determining a frequency spectrum of samples of said audio signal through a finite Fourier transformation, and a quantizer connected to said finite Fourier transformer, and quantizing peak frequency values of said frequency spectrum to frequency values expressing pitch names of a music scale.

15. The automatic player musical instrument as set forth in claim 10, in which said pointer includes a selector extracting plural groups of prepared features around a value of said lapse of time and plural groups of actual features from said prepared features and said actual features, respectively, a similarity analyzer connected to said selector and successively comparing each of said plural groups of prepared features with said plural group of actual features for determining similarity of combinations between said each of said plural groups of prepared features and said plural groups of actual features, and a determiner determining the combination with the maximum similarity as said group of prepared features identical with said group of actual features.

16. The automatic player musical instrument as set forth in claim 10, in which said sound generating system produces a lapsed time signal representative of said lapse of time from said initiation, and supplies said lapsed time signal to said measure.

17. The automatic player musical instrument as set forth in claim 10, in which said sound generating system produces visual images expressing said lapse of time, and said measure has an image-pickup device for converting said visual image to a video signal and a character recognizer supplied with said visual image so as to determine said lapse of time.

18. The automatic player musical instrument as set forth in claim 10, further comprising a visual image producer producing visual images expressing candidate groups in which one of said candidate groups contains said playback pattern data codes, an input device connected to visual image producer and used by a user so as to select one of said candidate groups, and a similarity analyzer connected to said input device and said visual image producer, and calculating similarity between sets of prepared features expressed by sets of playback pattern data codes of said one of said candidate groups and said actual features for selecting one of said sets of prepared features as those expressed by said playback pattern data codes.

19. A method for establishing a sound generating system and an automatic player musical instrument in synchronization for ensemble, comprising the steps of:

a) preparing playback pattern data codes expressing prepared features of sound to be produced through said sound generating system in correlation with a lapse of time determined on a time unit, each of said prepared features appearing over a time period determined on another time unit shorter than said time unit;

b) extracting actual features of said sound from an audio signal, each of said actual features appearing over said time period, each of said actual features being determined on the basis of a predetermined number of samples of an audio signal expressing said sound, said another time unit being equal to another time period occupied by a predetermined number of said samples;

c) comparing said actual features with said prepared features so as to determine a group of prepared features identical with a group of actual features;

d) determining an accurate lapse of time from said initiation on said another time unit on the basis of said group of prepared features;

e) specifying at least one music data code to be processed for generating a tone together with said sound generated through said sound generating system on the basis of said group of prepared features; and f) supplying said at least one music data code to said automatic player musical instrument.

20. The method as set forth in claim 19, in which said step c) includes the sub-steps of c-1) sampling said audio signal for producing plural samples containing said predetermined number of samples from said audio signal, c-2) determining frequency spectra of groups of said samples forming parts of said plural samples, c-3) selecting groups of peak values of the frequency from said frequency spectra, c-4) quantizing said groups of peak values to groups of pitch names, c-5) calculating similarity between a group of pitch names expressed by said actual features and each of said plural groups of pitch names, and c-6) determining one of said groups of prepared features as said group of prepared features identical with said group of actual features.

* * * * *